US006924796B1

(12) United States Patent
Someya et al.

(10) Patent No.: US 6,924,796 B1
(45) Date of Patent: Aug. 2, 2005

(54) DOT-CLOCK ADJUSTMENT METHOD AND APPARATUS FOR A DISPLAY DEVICE, DETERMINING CORRECTNESS OF DOT-CLOCK FREQUENCY FROM VARIATIONS IN AN IMAGE CHARACTERISTIC WITH RESPECT TO DOT-CLOCK PHASE

(75) Inventors: Jun Someya, Tokyo (JP); Yoshiaki Okuno, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/568,031

(22) Filed: May 10, 2000

(30) Foreign Application Priority Data

Dec. 9, 1999 (JP) ..... 11-349718

(51) Int. Cl.[7] ..... G09G 5/00

(52) U.S. Cl. ..... 345/213; 345/98; 348/536; 348/537

(58) Field of Search ..... 345/581, 660, 345/98, 3.2, 213, 691, 443, 214; 348/536, 537, 538, 540, 541; 347/249

(56) References Cited

U.S. PATENT DOCUMENTS 4,998,169 A * 3/1991 Yoshioka ..... 348/537
5,402,337 A * 3/1995 Nishide ..... 345/426
5,805,149 A * 9/1998 Yuki et al. ..... 345/555
5,940,136 A * 8/1999 Abe et al. ..... 348/537
6,002,449 A * 12/1999 Tsyrganovich ..... 348/725
6,226,045 B1 * 5/2001 Vidovich ..... 348/539
6,246,803 B1 * 6/2001 Gauch ..... 382/276
6,256,003 B1 * 7/2001 Tsuchiya et al. ..... 345/87
6,271,850 B1 * 8/2001 Kida et al. ..... 345/422
6,304,296 B1 * 10/2001 Yoneno ..... 348/537
6,450,647 B1 * 9/2002 Takeuchi ..... 353/69
6,493,031 B1 * 12/2002 Washizawa ..... 348/335
6,539,103 B1 * 3/2003 Panin et al. ..... 382/131

FOREIGN PATENT DOCUMENTS

JP A11175033 7/1999
JP A11177847 7/1999

* cited by examiner

*Primary Examiner*—Xiao Wu
*Assistant Examiner*—Abbas Abdulselam
(74) *Attorney, Agent, or Firm*—Birch, Stewart, Kolasch & Birch, LLP

(57) ABSTRACT

The frequency of the dot clock in an image display device is adjusted by calculating a first image characteristic from the differences between adjacent picture elements, varying the phase of the dot clock, determining whether the frequency of the dot clock is correct from the way the first image characteristic varies according to the phase of the dot clock, and changing the frequency if it is incorrect. The first image characteristic is, for example, the maximum difference, the histogram distribution of the differences, or a ratio calculated from the histogram. The phase of the dot clock may be adjusted according to a second image characteristic, such as the difference between a single pair of pixel values, which is also measured over a range of dot-clock phase settings.

32 Claims, 18 Drawing Sheets

DOT-CLOCK ADJUSTMENT METHOD AND APPARATUS FOR A DISPLAY DEVICE, DETERMINING CORRECTNESS OF DOT-CLOCK FREQUENCY FROM VARIATIONS IN AN IMAGE CHARACTERISTIC WITH RESPECT TO DOT-CLOCK PHASE

BACKGROUND OF THE INVENTION

The present invention relates to the adjustment of the dot clock in a matrix display device such as a liquid-crystal panel, digital micromirror device (DMD), plasma display panel (PDP), or field-emission display (FED).

These devices commonly use an analog-to-digital converter (ADC) to convert an analog image signal to the digital the signal needed for a matrix display. The dot clock is the sampling clock of the ADC. Before the display of the image begins, the dot clock must be adjusted in frequency and phase so that the analog image signal will be sampled at the correct points. Various methods of performing these adjustments automatically are known.

For example, Japanese Unexamined Patent Application No. 11-175033 discloses the liquid crystal display device shown in FIG. 1, having an ADC 101, a phase-locked loop (PLL) 102, a clock phase automatic adjusting means 103, a counter 104, an image detector 105, a pulse generator 106, and a control means 107. The ADC 101 receives an analog image signal that includes image information interspersed with vertical and horizontal blanking intervals. The image detector 105 detects the starting and ending points of the image information in the digitized image signal output from the ADC 101. The control means 107 sets the frequency division ratio of the PLL 102 according to the difference between the starting and ending points, so that the displayed image will have the same width as the screen of the liquid crystal display (LCD, not visible). The PLL 102 locks the frequency of the dot clock (DCLK) at the set ratio in relation to an input horizontal synchronizing signal (HSYNC).

After the dot-clock frequency has been adjusted in this way, the clock phase automatic adjusting means 103 detects the phase difference between the image signal and the dot clock, and generates a voltage that increases with this difference. The control means 107 uses this voltage signal to adjust the phase of the dot clock so that transition points in the image-signal waveform coincide with transition points in the dot-clock waveform. After the phase adjustment, the image detector 105 again detects the start of the image, and the control means 107 uses the result to control the pulse generator 106 so that each horizontal line of the displayed image starts at the left edge of the display screen.

A problem with this method is that it assumes that the image is always intended to fill the entire width of the display screen. The adjustment fails when this assumption is false, as when an image with a black border is displayed.

As another example of the prior art, Japanese Unexamined Patent Application No. 11-177847 discloses a device that automatically adjusts the frequency and phase of the dot clock so as to maximize the absolute difference between the values of adjacent pixels.

To explain this method, FIG. 2 shows an image comprising a pattern of high-contrast vertical stripes, displayed with the correct dot-clock frequency and phase. FIG. 3 shows the same image displayed with the correct frequency but incorrect phase; the stripes appear faint and low in contrast. The absolute difference between adjacent pixel values at the edges of the stripes is lower in FIG. 3 than in FIG. 2. The dot-clock phase is adjusted by varying the phase until the maximum absolute difference is obtained.

FIG. 4 shows the same image displayed with the incorrect dot-clock frequency; the stripes now vary periodically between high and low contrast. The average absolute difference between adjacent pixel values is less than in FIG. 2. The dot-clock frequency is adjusted by varying the frequency division ratio of the PLL until the average absolute difference is maximized.

One problem with this method is illustrated in FIG. 5, which shows the same image displayed at the same incorrect dot-clock frequency as in FIG. 4, but with a different dot-clock phase. The stripes vary between high and low contrast with the same period as before, but the high- and low-contrast stripes now appear in different positions. FIG. 5 happens to have more low-contrast stripes than FIG. 4, so the average absolute difference between adjacent pixel values is lower in FIG. 5 than in FIG. 4, even though the dot-clock frequency is the same in both cases.

There are also cases (not illustrated) in which different dot-clock frequencies produce the same average absolute difference, or in which the average absolute difference increases as the dot-clock frequency moves away from the correct frequency. Adjusting the dot-clock frequency according to the average absolute difference between adjacent pixel values thus turns out to be an uncertain process, and the adjustment does not necessarily succeed unless all possible frequencies are tested one by one, a very time-consuming operation.

SUMMARY OF THE INVENTION

An object of the present invention is to provide a dot-clock adjustment method that does not require a screen-filling image.

Another object of the invention is to provide a dot-clock adjustment method that can quickly and accurately distinguish between correct and incorrect dot-clock frequencies. The invented dot-clock adjustment method comprises the steps of:

(a) sampling an image signal in synchronization with a dot clock having a certain frequency and phase;

(b) calculating a first image characteristic from the differences between consecutively sampled values over a certain interval in the image;

(c) repeating steps (a) and (b) while varying the dot-clock phase, thereby measuring the first image characteristic over a range of phase values;

(d) deciding whether the frequency of the dot clock is correct, according to the results obtained in step (c); and (e) changing the frequency of the dot clock, and repeating steps (a) to (d), if the frequency is incorrect.

The first image characteristic may be, for example, a maximum or minimum difference between consecutively sampled values, the histogram distribution of the difference values, or a ratio calculated from the histogram distribution.

The invented method may also comprise the steps of:

(f) detecting a second image characteristic from the difference between consecutively sampled values when the dot-clock frequency is correct;

(g) repeating step (f) while varying the dot-clock phase, thereby measuring the second image characteristic over a range of phase values; and (h) adjusting the phase of the dot clock according to the results obtained in step (g).

The second image characteristic may be, for example, the maximum or minimum difference between adjacent pixel values, or the difference between the values of a particular pair of pixels.

The invention also provides apparatus employing the invented dot-clock adjustment method.

DETAILED DESCRIPTION OF THE INVENTION

Figure 1:
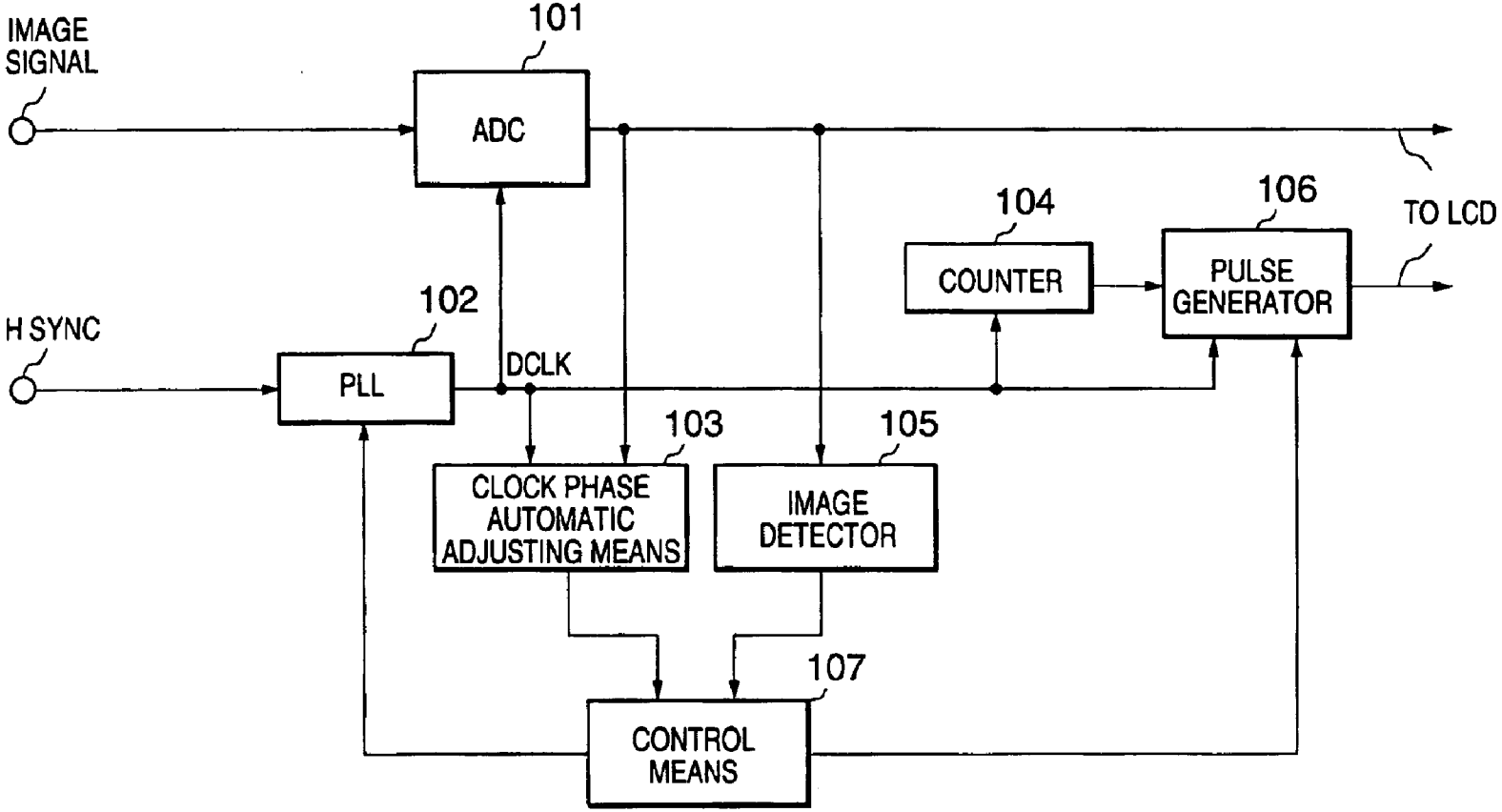
FIG. 1 PRIOR ART
FIG. 1 is a block diagram illustrating a display apparatus exemplifying the prior art.

Embodiments of the invention will be described with reference to the attached drawings, in which like parts are indicated by like reference characters.

Figure 6:
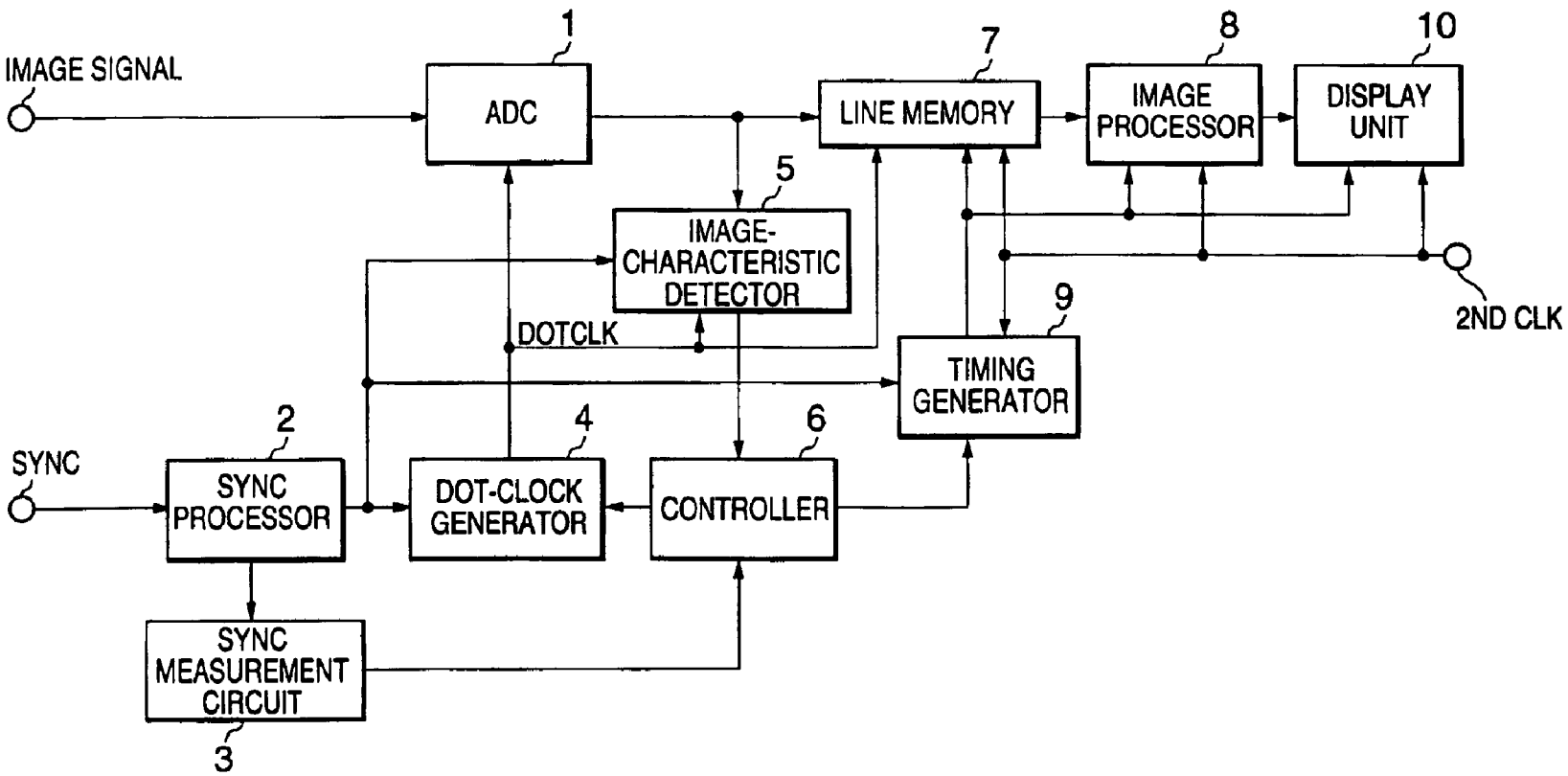
FIG. 6 is a block diagram of a display apparatus embodying the present invention.

Referring to FIG. 6, the first embodiment is a display apparatus comprising: an analog-to-digital converter (ADC) 1 that samples an input image signal in synchronization with a dot clock (DOTCLK), thereby converting the image signal to digital data; a synchronizing signal (SYNC) processor 2 that processes an input composite synchronizing signal to obtain a horizontal synchronizing signal and a vertical synchronizing signal; a synchronizing signal measurement circuit 3 that measures various properties of the horizontal and vertical synchronizing signals; a dot-clock generator 4 that generates the dot clock from the horizontal synchronizing signal; an image-characteristic detector 5 that calculates image characteristics from the image data output by the ADC 1; a controller 6 that controls the dotclock generator 4, adjusts the frequency and phase of the dot clock according to the information obtained by the synchronizing signal measurement circuit 3 and image-characteristic detector 5, and also controls a timing generator that will be described below; a line memory 7 that stores the image data in synchronization with the dot clock, and supplies readout of the stored image data in synchronization with a second clock signal (2NDCLK) received from an external source; an image processor 8 that processes the image data read from the line memory 7; the above-mentioned timing generator 9, which controls the line memory 7 according to the horizontal and vertical synchronizing signals, the second clock signal, and commands from the controller 6; and a display unit 10 such as a liquid crystal panel, cathode-ray tube (CRT), DMD, PDP, FED, or the like. The display unit 10 operates in synchronization with the second clock signal, under control of the timing generator 9.

The controller 6 comprises a computing device such as a microprocessor or microcontroller. The controller 6 includes memory circuits (not visible) storing information about standard image signal formats, such as the formats recommended by the Video Electronics Standards Association (VESA).

The image processor 8 comprises, for example, a digital signal processor. The other elements in FIG. 6, aside from the display unit 10, comprise various types of integrated circuits, some of which may be integrated with each other or with the controller 6.

Figure 7:
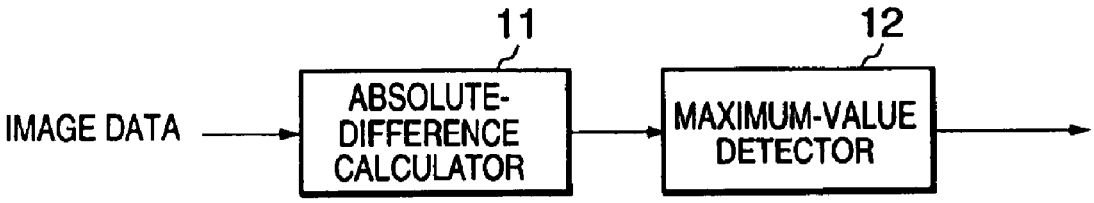
FIG. 7 is a block diagram showing the internal structure of the image-characteristic detector in FIG. 6.

Referring to FIG. 7, the image-characteristic detector 5 comprises: an absolute-difference calculator 11 that calculates the absolute values of the differences between consecutive pixels in the image data received from the ADC 1; and a maximum-value detector 12 that finds the maximum absolute difference value calculated by the absolute-difference calculator 11 over a specified interval such as, for example, one image frame interval (substantially 16.7 milliseconds, if the frame rate is sixty hertz.)

Next, the dot-clock frequency and phase adjustment operations will be described.

Besides separating the horizontal and vertical synchronizing signals, the synchronizing signal processor 2 controls the polarity of these signals, discards unnecessary pulses such as equalizing pulses, and supplies missing necessary pulses to generate correct horizontal and vertical synchronizing signals for input to the synchronizing signal measurement circuit 3, dot-clock generator 4, and timing generator 9. The synchronizing signal measurement circuit 3 measures at least the period, pulse width, and polarity of these synchronizing signals.

The controller 6 compares the information obtained by the synchronizing signal measurement circuit 3 with the above-mentioned information about standard image signal formats, selects the standard format that matches the measured results most closely, and sets the dot-clock generator 4 so as to generate a dot clock having the frequency specified in the selected standard format. The dot-clock generator 4 supplies the dot clock to the ADC 1, image-characteristic detector 5, and line memory 7. At this point, the dot clock may have any phase.

The ADC 1 now begins sampling the input image signal, and the image-characteristic detector 5 begins detecting absolute differences between adjacent pixels. After a specified interval (one frame, for example), the image-characteristic detector 5 informs the controller 6 of the maximum absolute difference detected in the interval. The controller 6 stores this information, then changes the dot-clock phase by controlling the dot-clock generator 4.

The above process is now repeated, as the ADC 1 samples the input image signal in synchronization with the new dot clock. The image-characteristic detector 5 obtains another maximum absolute difference for an interval of the same length as before. The controller 6 stores the new difference value, then changes the dot-clock phase again.

Figure 8:
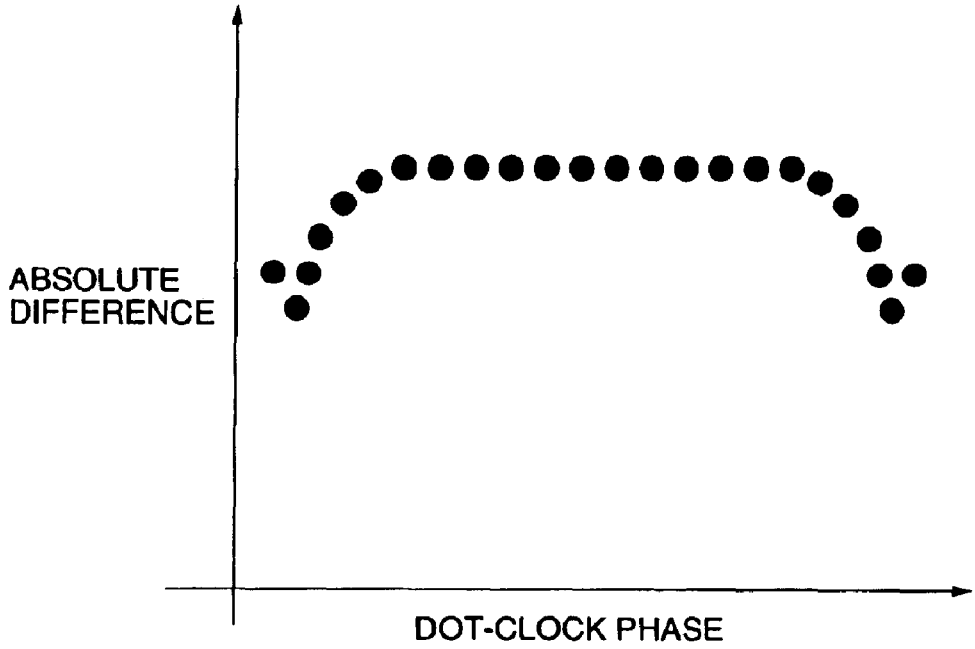
FIGS. 8 and 9 show examples of maximum absolute difference characteristics.
Figure 9:
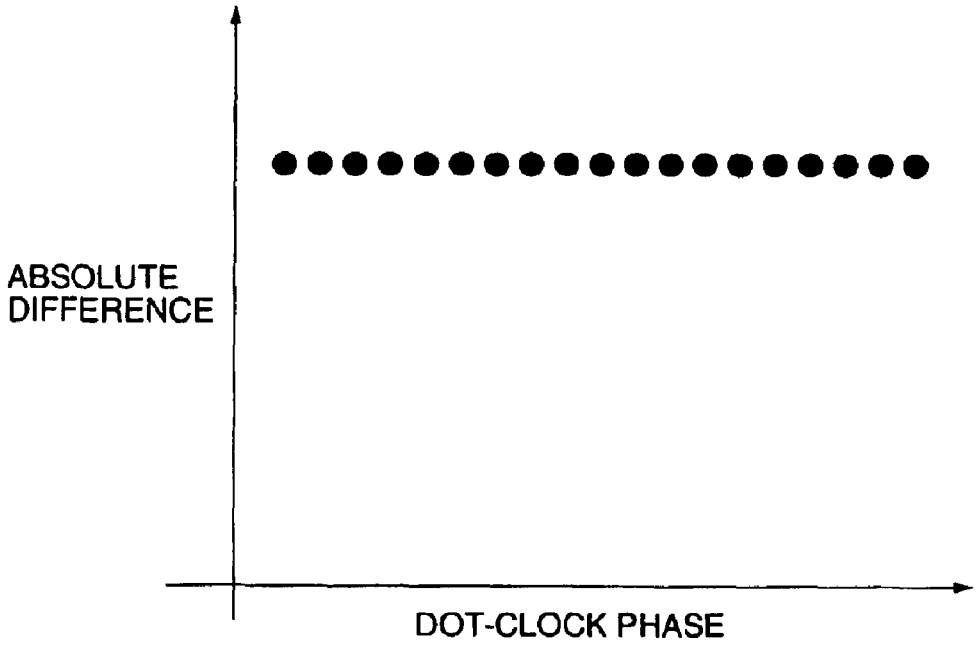

Continuing in this way, the controller 6 obtains a sequence of maximum absolute difference values characterizing different dot-clock phases as shown, for example, in FIG. 8 or 9. The horizontal axis in these drawings represents the dot-clock phase, while the vertical axis esents the maximum absolute difference between adjacent pixels in the specified interval.

FIG. 8 shows a typical result when the dot-clock frequency is correct; the curve of maximum absolute difference values has a broad peak disposed between two valleys. Peaks and valleys will be referred to as maxima and minima below, and both will be referred to collectively as extrema.

Figure 4:
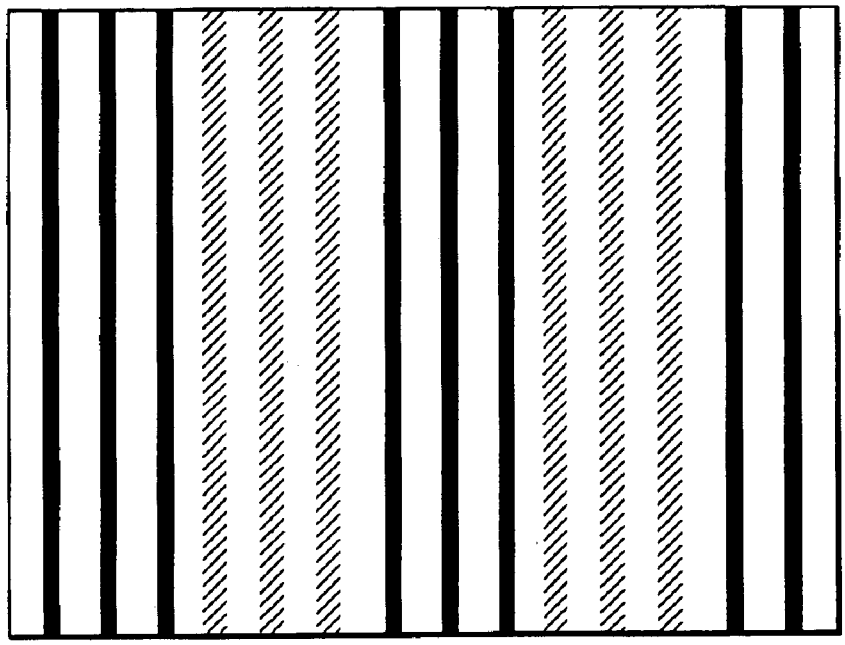
FIG. 4 PRIOR ART
FIGS. 4 and 5 illustrate the same pattern displayed with incorrect dot-clock frequency.
Figure 5:
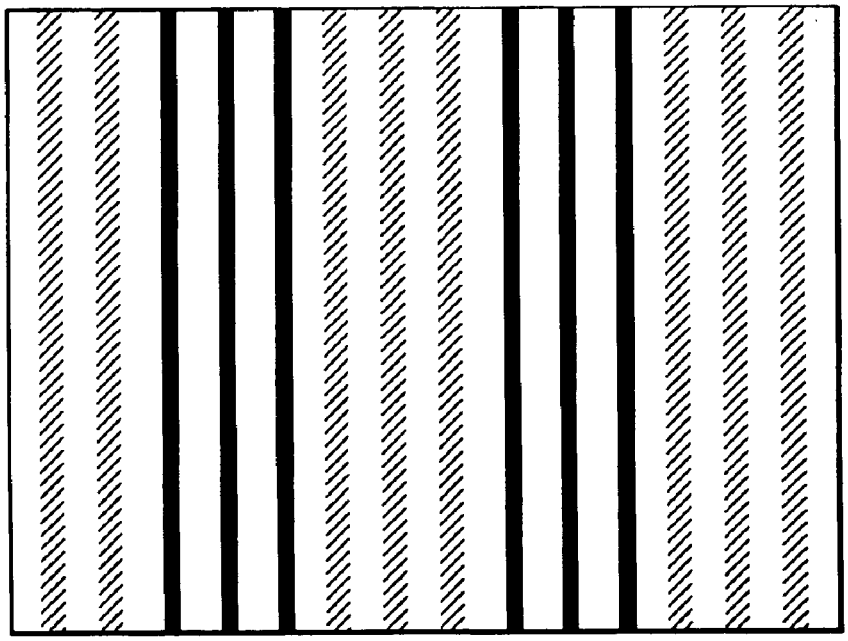
FIG. 5 PRIOR ART

FIG. 9 shows a typical result when the dot-clock frequency is incorrect; the curve is substantially flat and has no peaks or valleys. The reason for this flat characteristic can be understood from FIGS. 4 and 5, in which, because of the incorrect dot-clock frequency, the maximum absolute difference between adjacent pixels is the same regardless of the dot-clock phase.

If the sequence of maximum absolute difference values obtained from the image-characteristic detector 5 has at least one extremum, the controller 6 accepts the present dot-clock frequency as correct, and proceeds to the phase-adjustment operation.

If the sequence of maximum absolute difference values has no extrema, the controller 6 rejects the current dot-clock frequency, and selects another frequency. The above process is then repeated at this new dot-clock frequency. The controller 6 changes the dot-clock frequency as often as necessary until a frequency producing a characteristic curve with at least one extremum is found.

Strictly speaking, any sequence that includes at least two different values has an extremum, but the controller 6 need not use this strict definition. Preferably, the controller 6 determines the amount of variation in the sequence of values output by the image-characteristic detector 5, and recognizes the presence of an extremum if the amount of variation exceeds a predetermined level. The amount of variation may be calculated as, for example, the difference between the highest and lowest values in the sequence, the non-linearity of the curve, or in various other ways.

When the correct dot-clock frequency has been found, the controller 6 re-examines the sequence of maximum absolute difference values obtained at this frequency to find a dot-clock phase that produces the largest maximum value. The controller 6 then adjusts the dot clock to this phase by controlling the dot-clock generator 4.

This completes the adjustment of the dot clock. The line memory 7 now begins storing the image data output by the ADC 1, and the image processor 8 begins reading the image data from the line memory 7 and performing such processes as zoom adjustment, brightness and contrast adjustment, edge enhancement, noise reduction, gamma correction, and color correction. The processed image is displayed on the display unit 10.

Figure 10:
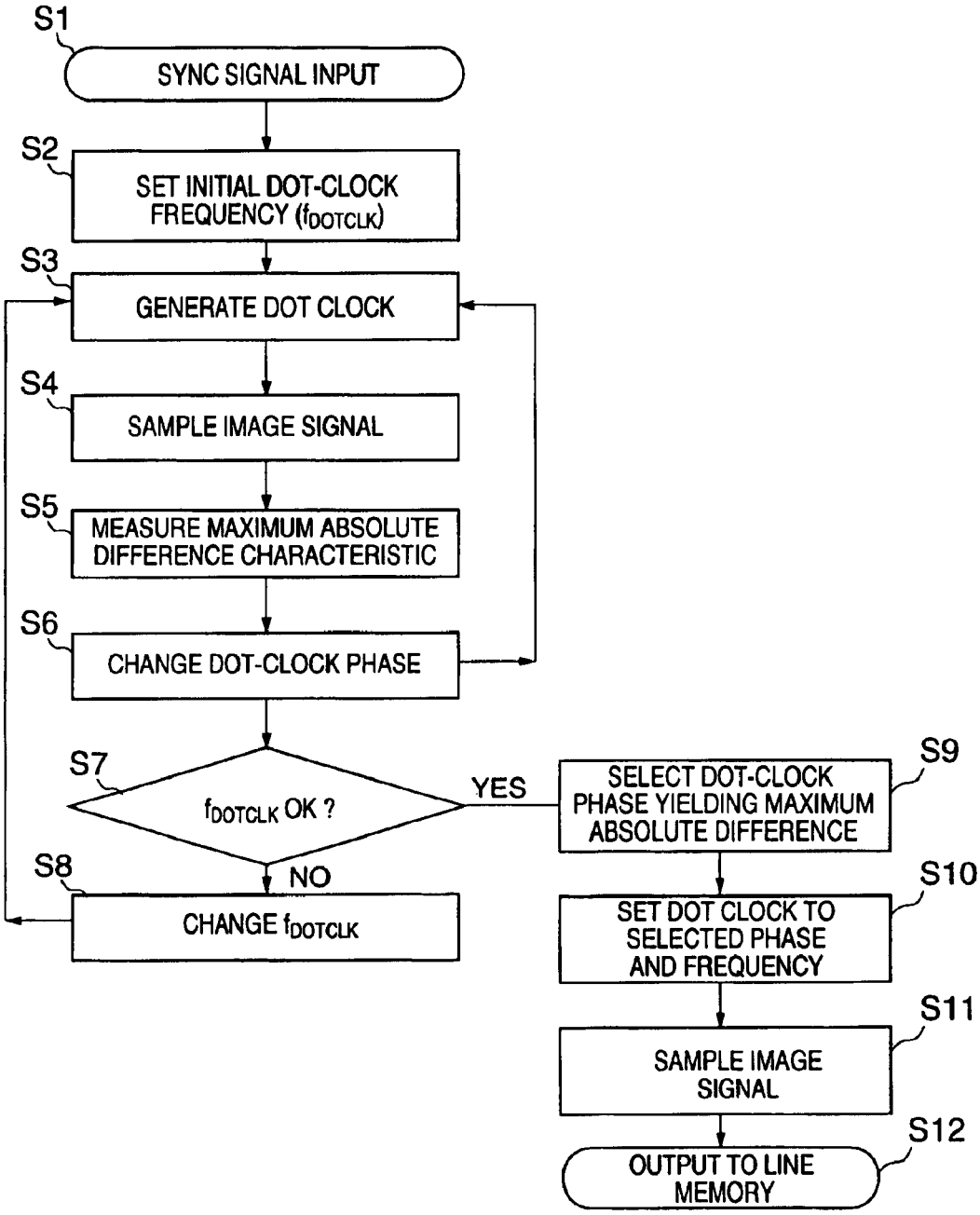
FIG. 10 is a flowchart illustrating dot-clock adjustment by the apparatus in FIGS. 6 and 7.

The dot-clock adjustment procedure is summarized in FIG. 10. After input of the synchronizing signals begins (step S1) an initial dot-clock frequency $f_{DOTCLK}$ is set (step S2) the dot clock is generated at this frequency (step S3), and the image signal is sampled in synchronization with the dot clock (step S4). The image-characteristic detector 5 measures the maximum absolute difference between adjacent pixel values over a specified interval (step S5). After this measurement is completed, the controller 6 changes the dot-clock phase (step S6). In this step, the dot-clock phase is, for example, advanced by a predetermined amount. Steps S3 to S6 are repeated until, for example, the dot-clock phase has been advanced by a total amount equal to at least one complete phase cycle (360°). The controller 6 then decides, from the maximum absolute difference values measured in step S5, whether the current dot-clock frequency $f_{DOTCLK}$ is correct (step S7).

If the dot-clock frequency is found to be incorrect in step S7, because the maximum absolute difference characteristic lacks sufficient variation, the dot-clock frequency is changed (step S8). For example, the controller 6 increments a frequency division ratio used in the dot-clock generator 4 by a predetermined amount (n). The entire loop from step S3 to step S7 is then repeated. If the result in step S7 is again that the dot-clock frequency is incorrect, it is changed once more. This time, for example, the frequency division ratio may be set to a value n less than the initial value. If necessary, frequency division ratios differing from the initial ratio by ±2n, ±3n, and so on may be tested until the correct dot-clock frequency is found.

When the correct dot-clock frequency has been found, the process branches from step S7 to select the dot-clock phase yielding the maximum absolute difference value (step S9). The dot clock is set to this phase (step S10) without changing the frequency selected as correct in step S7. The image signal is now sampled at the selected phase and frequency (step S11) and the sampled values are written in the line memory 7 (step S12) for further image processing and display.

This dot-clock adjustment method does not depend on detection of the starting and ending points of image information in the image signal to set the dot-clock frequency, so it is applicable regardless of the width of the displayed image.

This method also provides criteria for deciding whether each tested dot-clock frequency is correct or incorrect according to image-characteristic information obtained at the tested frequency. Thus, if the initial dot-clock frequency set in step S2 is correct, this will be recognized in step S7 without the need to test other frequencies. Accordingly, in the numerous cases in which the controller 6 identifies the image-signal format correctly from the information output by the synchronizing signal measurement circuit 3, the dot-clock adjustment process can be completed relatively quickly.

Next, a second embodiment will be described. The second embodiment uses a different characteristic to adjust the phase of the dot clock.

Figure 11:
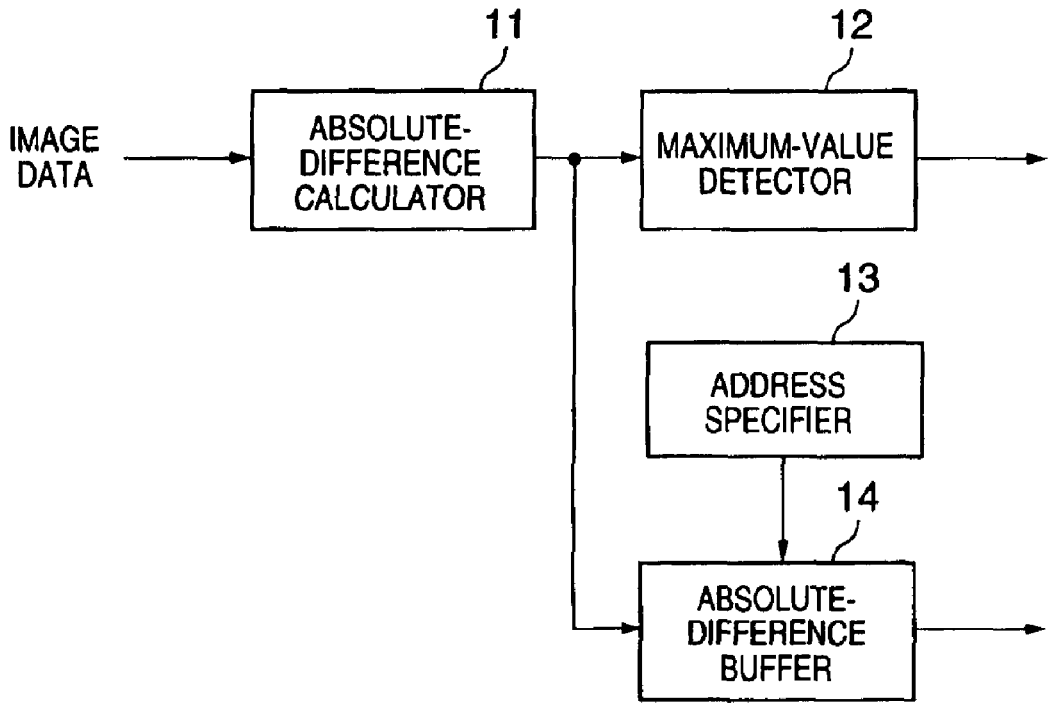
FIG. 11 is a block diagram showing the internal structure of the image-characteristic detector in a second embodiment of the invention.

Referring to FIG. 11, the image-characteristic detector 5 in the second embodiment comprises an absolute-difference calculator 11, a maximum-value detector 12, an address specifier 13, and an absolute-difference buffer 14. The absolute-difference calculator 11 and maximum-value detector 12 function as described in the first embodiment. The address specifier 13 specifies the address of a pair of pixels in a predetermined position, such as a position near the center of the screen, or another position expected to be within the image area. The absolute-difference buffer 14 stores the absolute difference values found by the absolute-difference calculator 11 for this pair of pixels.

The other elements shown in FIG. 6 are the same in the second embodiment as in the first embodiment, although the operation of the controller 6 differs, as described below.

Figure 12:
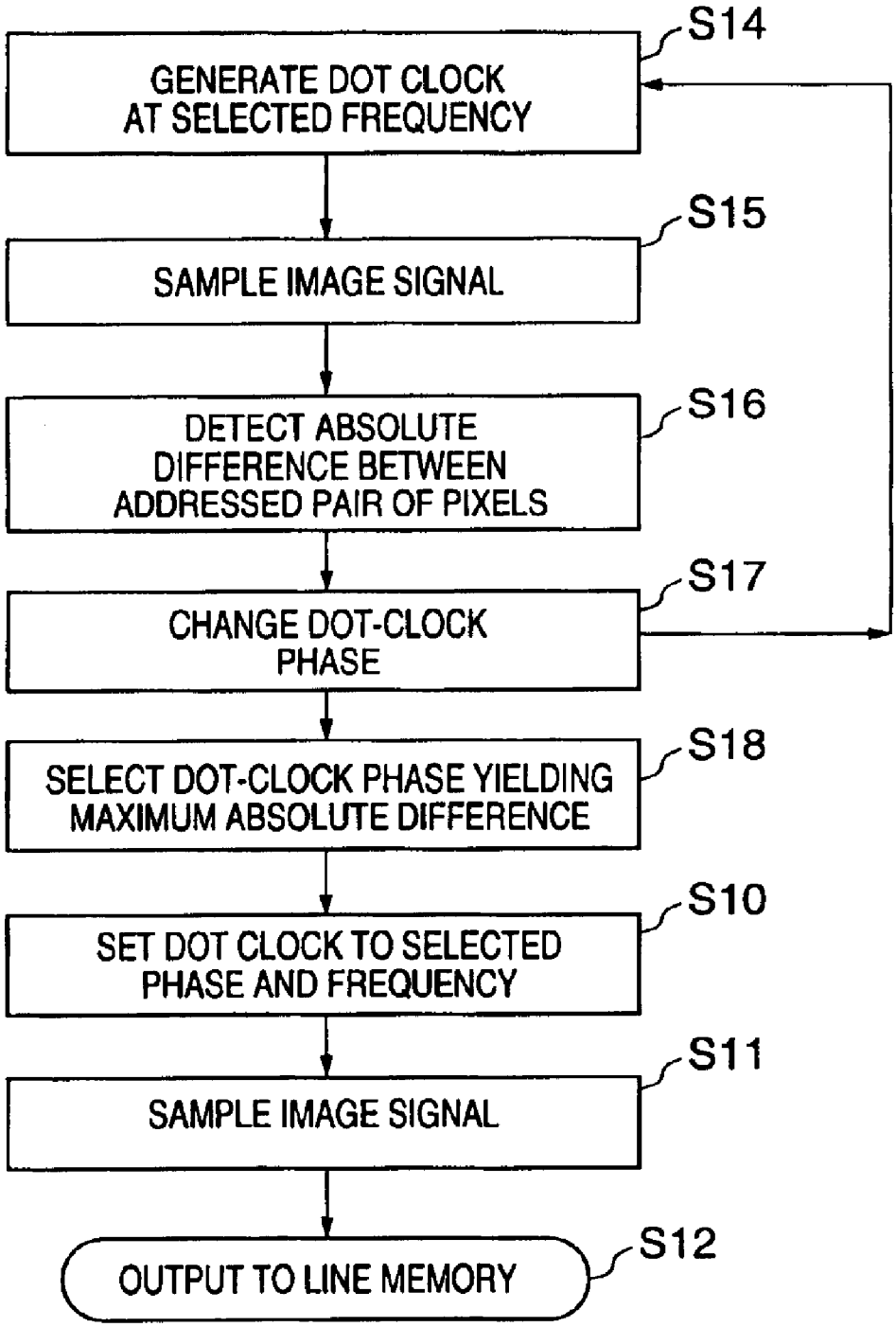
FIG. 12 is a flowchart illustrating dot-clock phase adjustment in the second embodiment.

The second embodiment adjusts the dot-clock frequency by the same procedure as in the first embodiment, following steps S1 to S8 in FIG. 10. After finding the correct frequency, however, the controller 6 branches from step S7 to the procedure shown in FIG. 12.

The dot-clock generator 4 continues to generate the dot clock (step S14) at the frequency identified as correct in step S7. The ADC 1 samples the image signal in synchronization with the dot clock (step S15). The absolute-difference calculator 11 detects the absolute difference between adjacent pixel values, and the absolute-difference buffer 14 stores the absolute difference between the two pixels at the location designated by the address specifier 13 (step S16). The controller 6 then changes the dot-clock phase (step S17), without changing the dot-clock frequency, and returns to step S14. The procedure from step S14 to step S17 is repeated for at least one complete dot-clock phase cycle (360°). The location designated by the address specifier 13 does not change. Each time, the absolute-difference buffer 14 stores the absolute difference between the values of the same two pixels. At the end of these repetitions, the absolute-difference buffer 14 stores a set of values forming a characteristic curve such as the one illustrated in FIG. 13.

The controller 6 now selects the phase that produced the maximum value stored in the absolute-difference buffer 14 (step S18). Steps S14 to S18 thus replace step S9 in the first embodiment (FIG. 10).

The succeeding steps (S10, S11, 512) are the same as in the first embodiment. The dot-clock generator 4 is set to the selected frequency and phase, the image signal is sampled with this frequency and phase, and the sampled values are stored in the line memory 7 for further processing and display.

Figure 13:
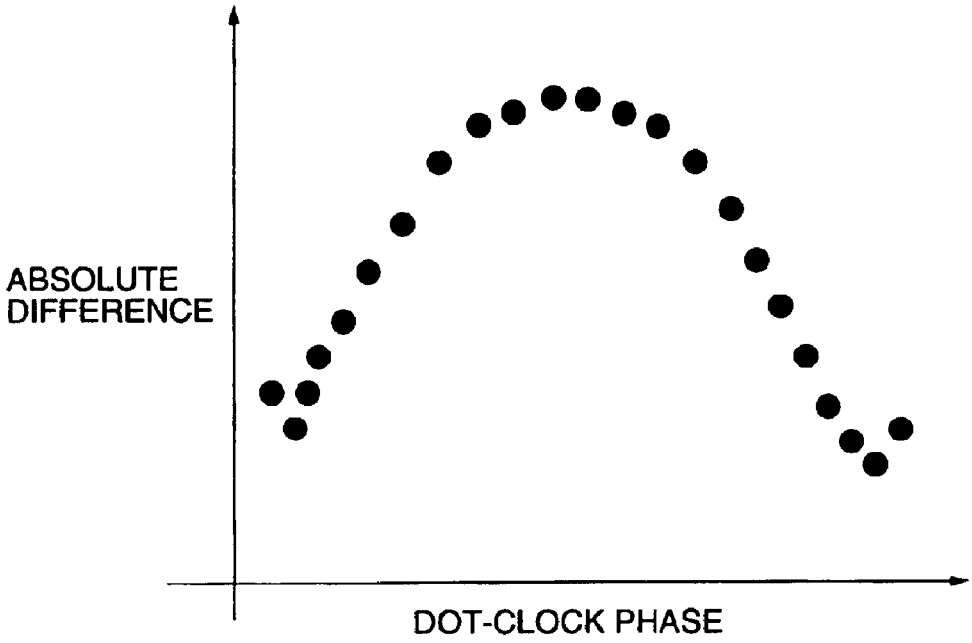
FIG. 13 shows an example of an absolute difference characteristic.

By examining the absolute difference between a particular pair of pixels, the second embodiment can usually obtain a characteristic curve with a single well-defined maximum, as in FIG. 13, even if the image being displayed is a natural image without sharp changes from one pixel to the next. If the maximum absolute difference over an entire frame is measured, as in the first embodiment, natural images, lacking features such as ruled lines and text, tend to produce characteristic curves such as the one in FIG. 8, without a single sharp maximum value. The correct phase can be identified more easily from a curve resembling the one in FIG. 13 than from a curve resembling the one in FIG. 8.

A further advantage of the second embodiment is that the characteristic curve obtained from a single pair of pixels is unlikely to be affected by clock jitter or noise.

Next, a third embodiment will be described. The third embodiment uses the maximum absolute difference characteristic to select the address used in the second embodiment.

Figure 14:
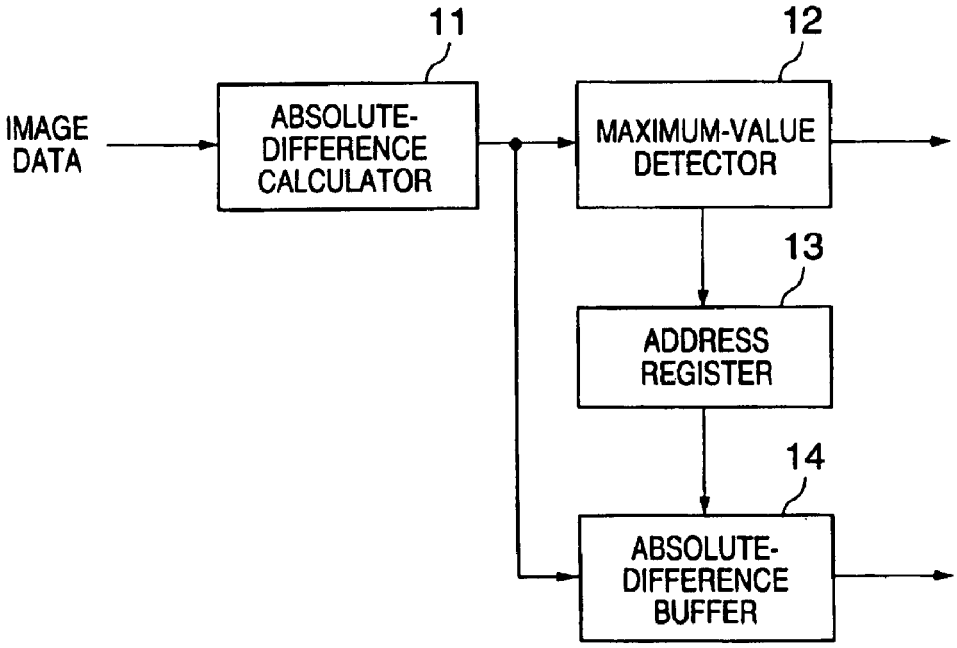
FIG. 14 is a block diagram showing the internal structure of the image-characteristic detector in a third embodiment of the invention.

Referring to FIG. 14, the image-characteristic detector 5 in the third embodiment comprises an absolute-difference calculator 11, an absolute-difference buffer 14, a maximum-value detector 15, and an address register 16. The maximum-value detector 15 detects the maximum absolute difference output from the absolute-difference calculator 11, as in the preceding embodiments, and also detects the address of a pair of pixels yielding this maximum absolute difference. The address register 16 stores the address detected by the maximum-value detector 15, and supplies this address to the absolute-difference buffer 14. The absolute-difference calculator 11 and absolute-difference buffer 14 operate as in the second embodiment.

The other elements of the third embodiment have the configuration shown in FIG. 6, and operate as described in the second embodiment.

The third embodiment adjusts the dot-clock frequency by substantially the same procedure as in the first embodiment, following steps S1 to S8 in FIG. 10. Each time the maximum-value detector 15 detects the maximum absolute difference in step S5, however, it also stores the pixel address at which the maximum absolute difference occurs in the address register 16. After the correct dot-clock frequency is found in step S7, the address register 16 holds the address of a pair of pixels that yielded a maximum absolute difference at this dot-clock frequency. The controller 6 now branches from step S7 to the procedure shown in FIG. 15.

This procedure is identical to the procedure used in the second embodiment, except that the address register 16 outputs the address detected in step S5 as yielding a maximum absolute-difference value, the last time step S5 was performed during the frequency adjustment process, and the absolute-difference buffer 14 stores the absolute difference between the pair of pixels at this address (step S19). The address register 16 continues to supply the same address while steps S14, S15, S19, and S17 are repeated for at least one complete dot-clock phase cycle (360°). At the end of the cycle, the absolute-difference buffer 14 stores a set of values forming a characteristic curve such as the one illustrated in FIG. 13. The controller 6 selects the phase that produced the maximum value stored in the absolute-difference buffer 14 (step S18), the dot-clock generator 4 is set to the selected frequency and phase (step S10), the image signal is sampled with this frequency and phase (step S1l), and the sampled values are stored in the line memory 7 for further processing and display (step S12).

The third embodiment provides the same effects as the second embodiment, but in the phase-adjustment process, by selecting a pair of pixels at which a maximum absolute difference value was detected earlier, the third embodiment ensures that a difference actually exists between the two selected pixels, and that the difference is relatively large, in comparison with the differences between other pairs of pixels.

For example, if the displayed image is a natural image with a black border, the third embodiment may select a comparatively bright pixel at an edge of the natural image and an adjacent pixel in the black border, thereby obtaining a greater absolute difference than could be obtained by selecting two pixels within the natural image itself. As a result, the characteristic curve obtained in the phase-adjustment procedure will have clearly defined maxima and minima, enabling the phase to be adjusted accurately.

Figure 15:
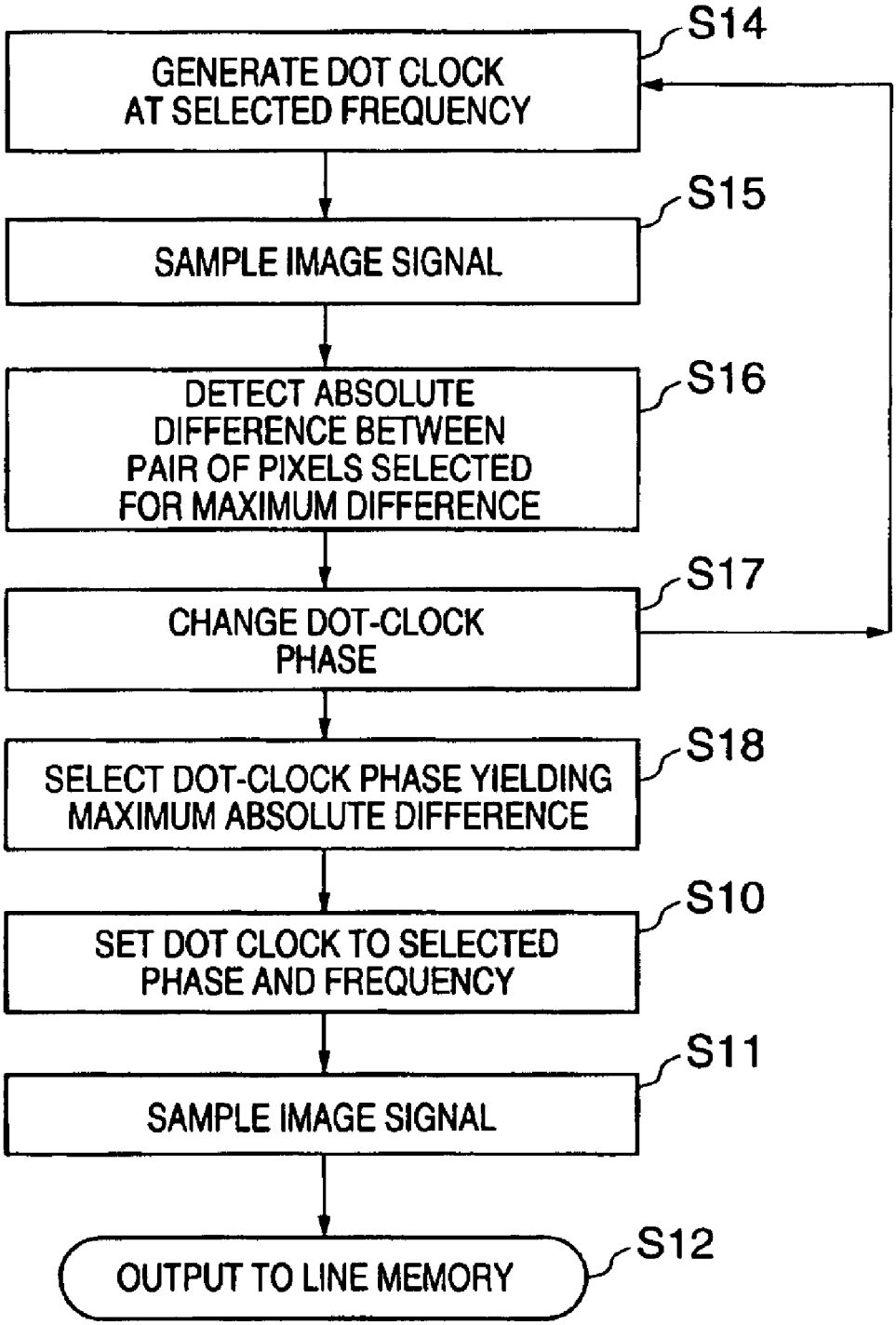
FIG. 15 is a flowchart illustrating dot-clock phase adjustment in the third embodiment.

In a variation of the third embodiment, instead of using the address that happens to be left in the address register 16 at the end of the frequency-adjustment procedure, the controller 6 provisionally selects a phase that maximized the maximum absolute difference characteristic, as in the first embodiment, and sets the dot clock to this phase. The image-characteristic detector 5 then measures the maximum absolute difference characteristic again, to load the address register 16 with the address of a pair of pixels that produce a maximum absolute difference at the provisionally selected phase. After this address has been determined, the procedure is FIG. 15 is carried out, using this address, to adjust the phase more precisely.

Next, a fourth embodiment will be described. The fourth embodiment adjusts the dot-clock phase as in the third embodiment, but adjusts the dot-clock frequency differently.

Figure 16:
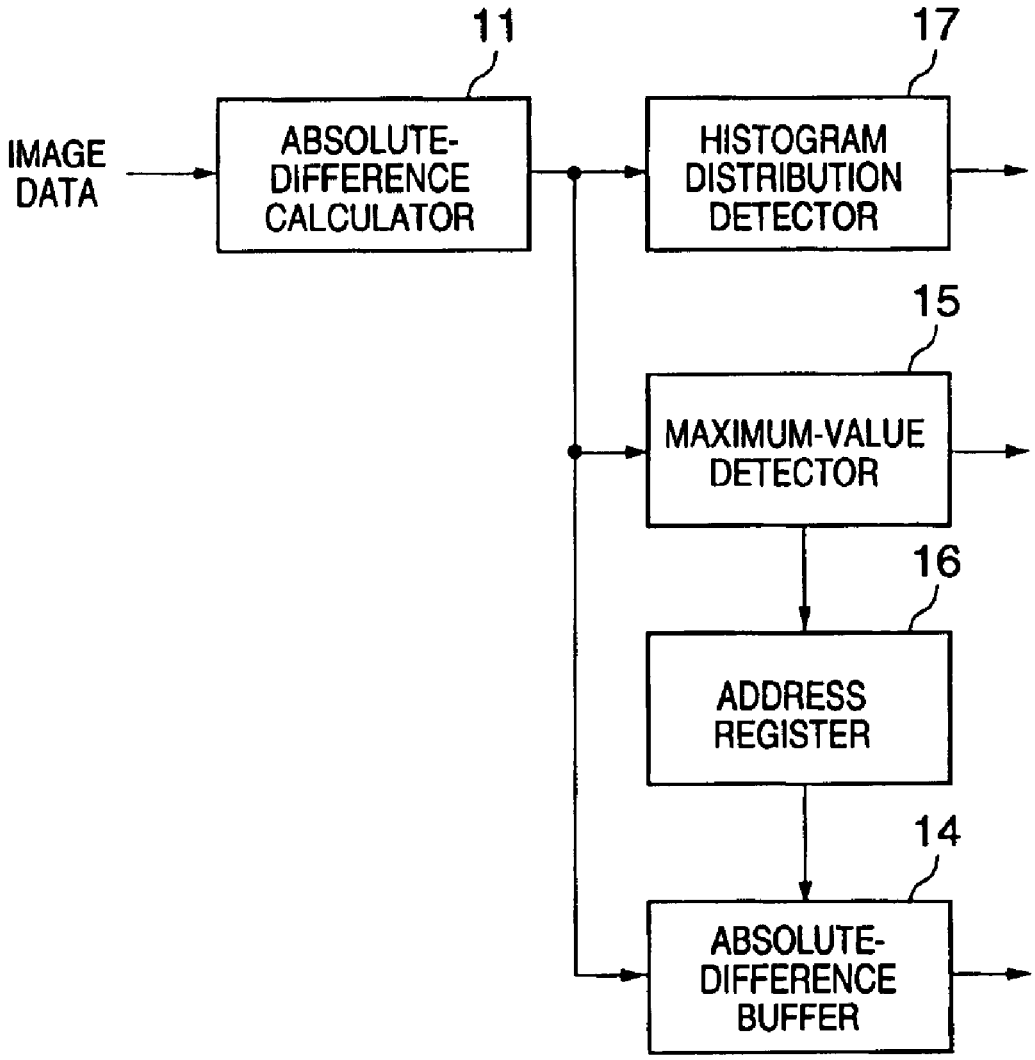
FIG. 16 is a block diagram showing the internal structure of the image-characteristic detector in a fourth embodiment of the invention.

Referring to FIG. 16, the image-characteristic detector 5 in the fourth embodiment comprises an absolute-difference calculator 11, an absolute-difference buffer 14, a maximum-value detector 15, and an address register 16 as described in the third embodiment, and a histogram distribution detector 17. The histogram distribution detector 17 generates data for a histogram of the absolute difference values output by the absolute-difference calculator 11 during a specified interval, such as one frame, and supplies the histogram data to the controller 6.

The other elements of the fourth embodiment have the configuration shown in FIG. 6. The elements other than the image-characteristic detector 5 and controller 6 operate as described in the preceding embodiments.

Figure 17:
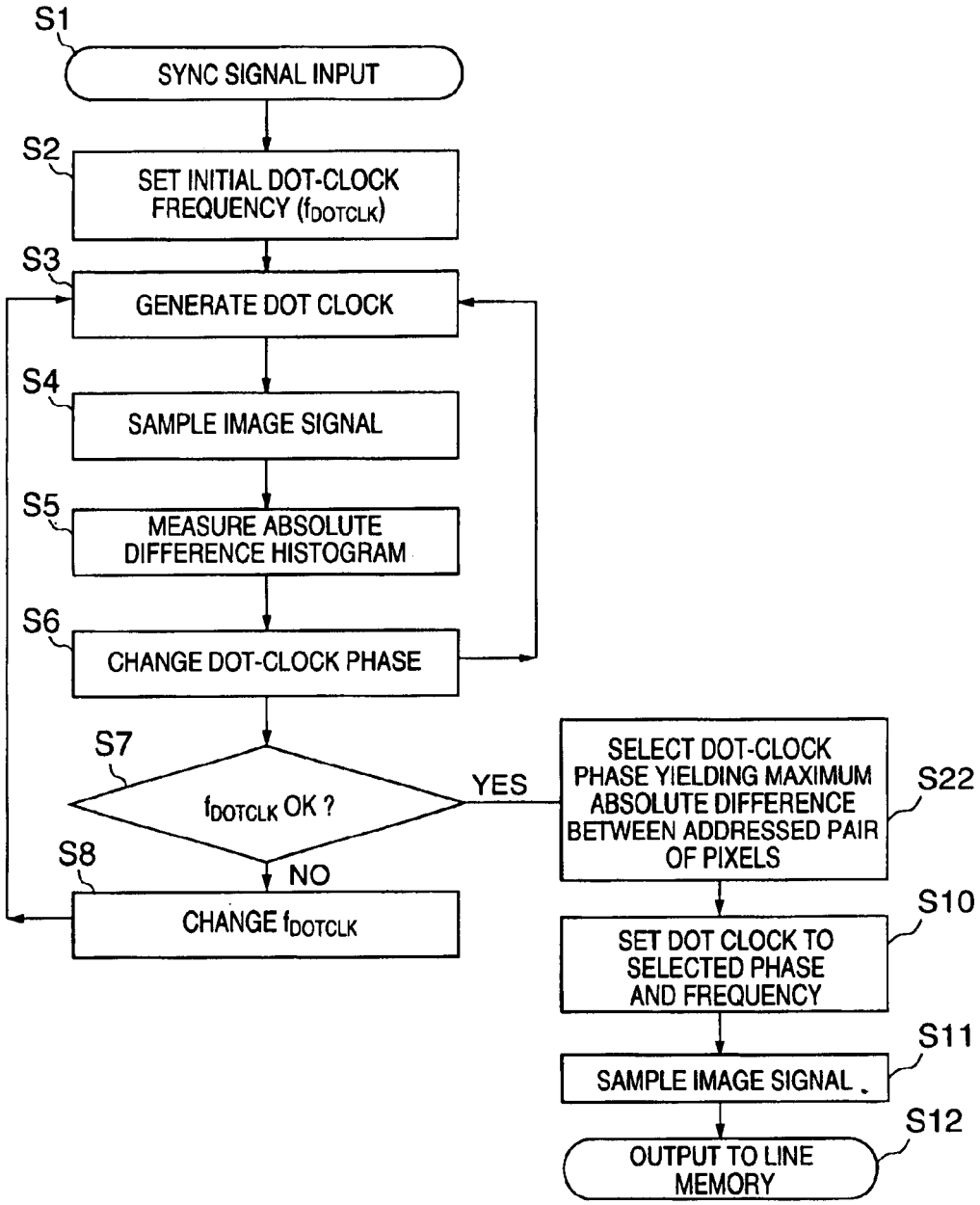
FIG. 17 is a flowchart illustrating dot-clock adjustment by the apparatus in the fourth embodiment.

Referring to FIG. 17, frequency adjustment commences as in the preceding embodiments (steps S1 to S4): after synchronizing-signal input begins, the controller 6 selects an initial dot-clock frequency, the dot clock is generated at this frequency, and the image signal is sampled in synchronization with the dot clock, while the absolute-difference calculator 11 detects the absolute difference between adjacent pixel values.

The histogram distribution detector 17 counts the number of times each absolute difference value is detected during an interval of one frame, for example, thereby obtaining the distribution of absolute difference values. To reduce the amount of distribution data, instead of counting each absolute difference value separately, the histogram distribution detector 17 may group the absolute difference values into a set of ranges, and obtain a single count for each range.

Figure 2:
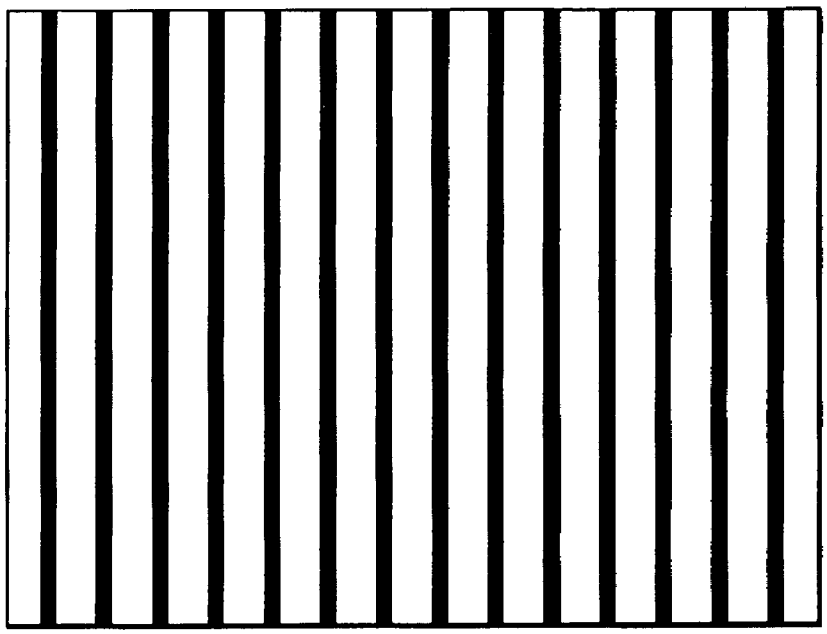
FIG. 2 PRIOR ART
FIG. 2 illustrates a pattern of vertical stripes.
Figure 3:
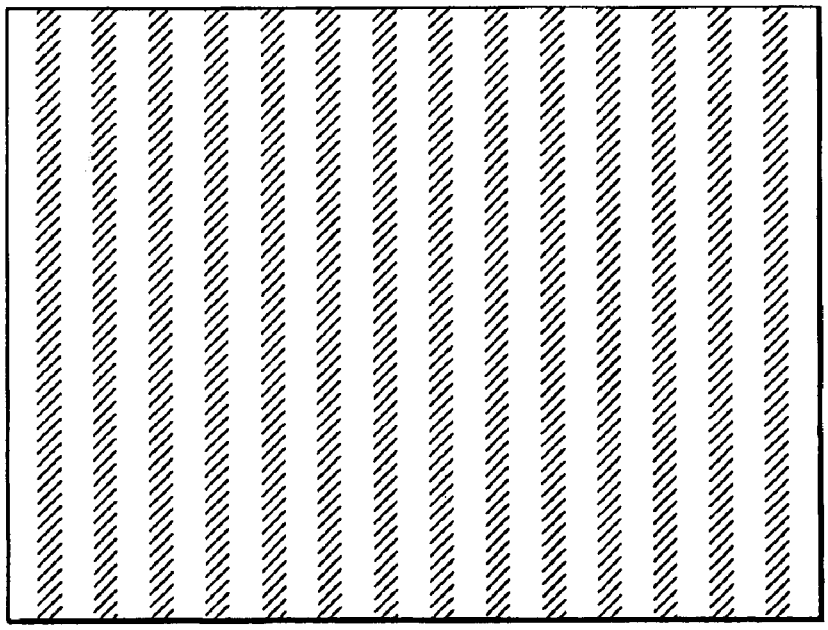
FIG. 3 PRIOR ART
FIG. 3 illustrates the same pattern displayed with incorrect dot-clock phase.
Figure 18:
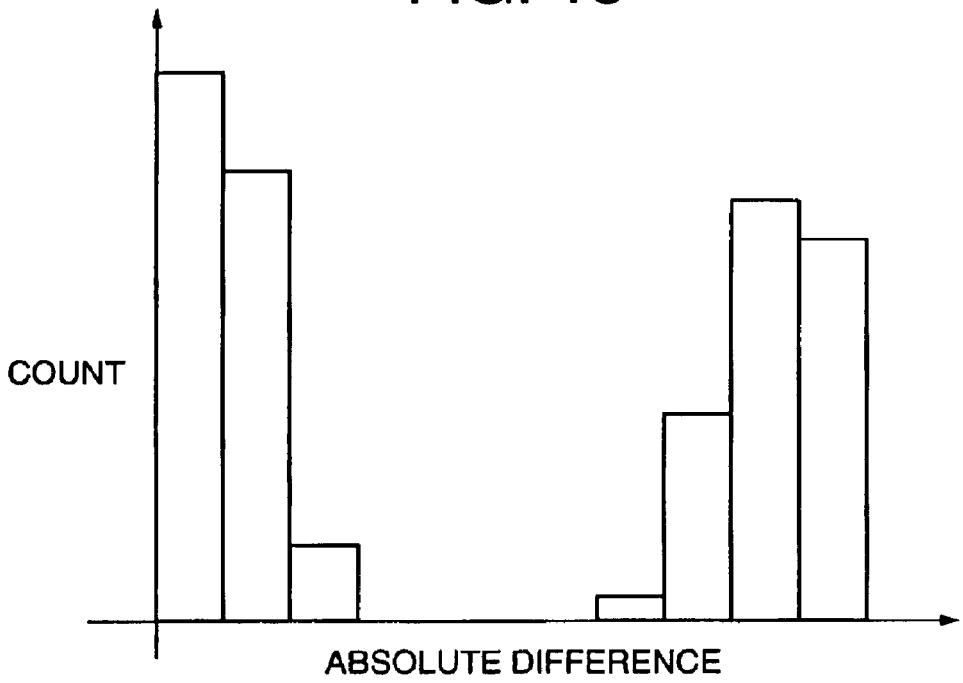
FIGS. 18, 19, and 20 show examples of histogram distributions.

FIG. 18 shows an example of a histogram for a vertical-stripe image of the type illustrated in FIG. 2, obtained when the dot-clock frequency and phase are both correct. The horizontal axis represents absolute difference values, and the vertical axis represents the number of times each absolute difference is detected in the specified interval.

Figure 19:
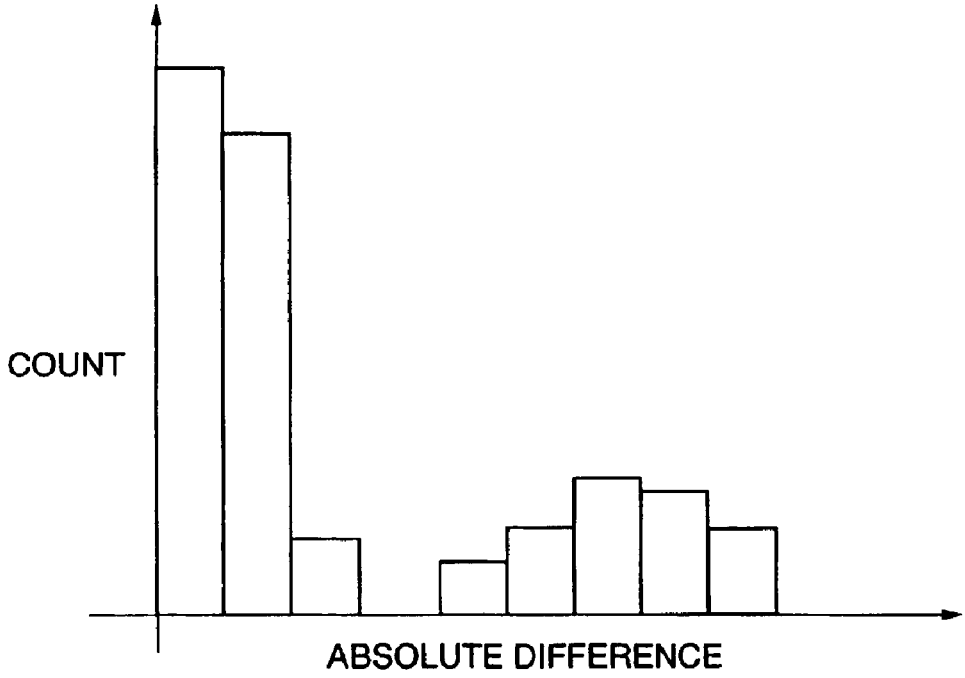

FIG. 19 shows the general form of a histogram obtained for the same vertical-stripe image, with the correct dot-clock frequency but an incorrect dot-clock phase. Compared with FIG. 18, the distribution of the highest absolute difference values is more spread out, and is shifted to the left.

Figure 20:
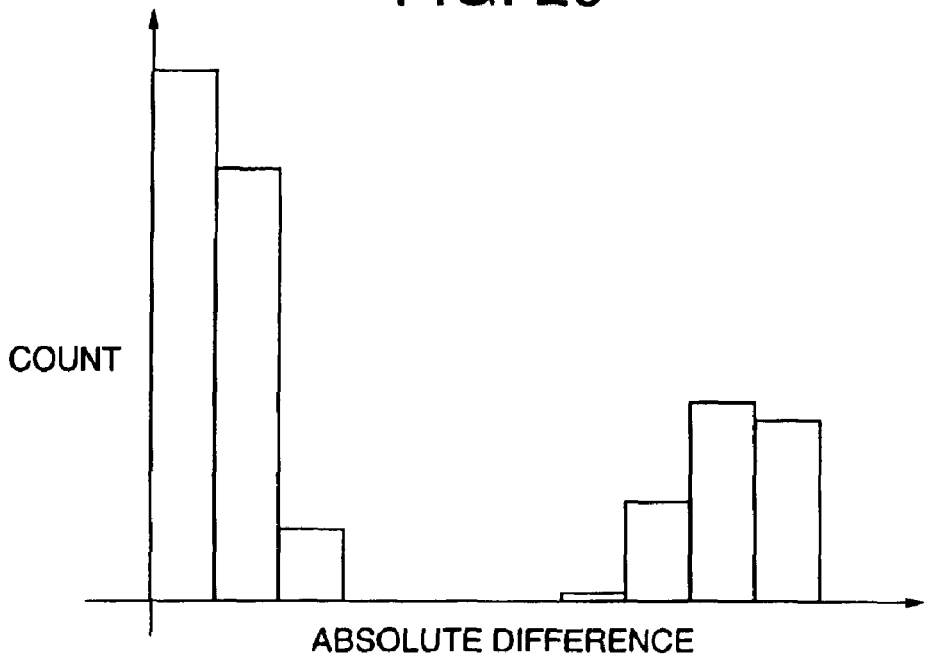

FIG. 20 shows the general form of a histogram obtained for the same vertical-stripe image with an incorrect dot-clock frequency. In this case, the shape of the histogram varies relatively little when the dot-clock phase is changed, as can be understood from FIGS. 4 and 5.

The differences between these histograms can be quantified in various ways, e.g., by measuring the total difference between corresponding counts, or the maximum difference between corresponding counts.

Steps S6 to S8 in FIG. 17 are substantially the same as in the preceding embodiments. The controller 6 measures the differences between histogram distributions obtained as the dot-clock phase is shifted over a complete (360°) cycle. If these differences exceed a predetermined level, the controller 6 recognizes the current dot-clock frequency as correct; otherwise, the controller 6 changes the dot-clock frequency and the entire process is repeated from step S3. In changing the dot-clock frequency, the controller 6 operates, for example, as described in the first embodiment, setting frequency division ratios that differ from the initial frequency division ratio by ±n, ±2n, ±3n, and so on, where n is a predetermined integer.

When a correct dot-clock frequency is recognized in step S7, the controller 6 selects the phase of the dot clock as described in the third embodiment (step S22). Specifically, the maximum-value detector 15 detects the address of a pair of pixels that produce a maximum absolute difference value at the correct dot-clock frequency and a certain dot-clock phase; the address register 16 stores this address; the absolute-difference buffer 14 stores absolute-difference data for this pair of pixels as the dot-clock phase is shifted through one complete cycle (360°); and the controller 6 selects the dot-clock phase that maximizes this absolute difference.

The remaining steps (S10, S11, S12) are the same as in the preceding embodiments: the dot-clock generator 4 is set to the selected dot-clock frequency and phase, the image signal is sampled at this frequency and phase, and the samples are output to the line memory 7 for further processing and display.

An advantage of the fourth embodiment is that each dot-clock frequency can be evaluated with fewer different phase settings than are necessary in the preceding embodiments, because a histogram distribution provides more information than does a single maximum absolute difference value. The frequency adjustment can thus be completed more quickly than in the preceding embodiments.

Next, a fifth embodiment will be described. The fifth embodiment differs from the fourth embodiment in that the histogram distribution is reduced to a single ratio value.

Figure 21:
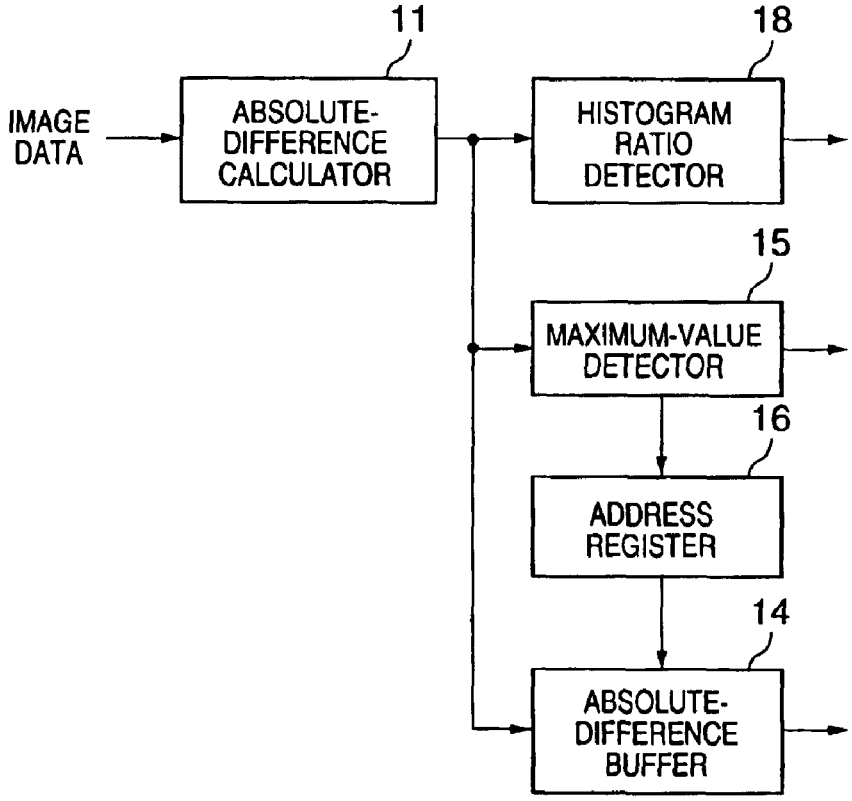
FIG. 21 is a block diagram showing the internal structure of the image-characteristic detector in a fifth embodiment of the invention.

Referring to FIG. 21, the image-characteristic detector 5 in the fifth embodiment comprises an absolute-difference calculator 11, an absolute-difference buffer 14, a maximum-value detector 15, and an address register 16 as described in the fourth embodiment, and a histogram ratio detector 18. The histogram ratio detector 18 obtains histogram data as described in the fourth embodiment, but instead of supplying the controller 6 with the entire distribution of each histogram, the histogram ratio detector 18 calculates the ratio of the maximum absolute difference value detected in the distribution to the sum of the count values obtained in a predetermined neighborhood of this maximum absolute difference value, and supplies the controller 6 with the calculated ratio. The predetermined neighborhood comprises, for example, the absolute difference values differing from the maximum absolute difference value by less than a predetermined amount.

The other elements of the fifth embodiment have the configuration shown in FIG. 6. The elements other than the image-characteristic detector 5 and controller 6 operate as described in the preceding embodiments.

The fifth embodiment follows the dot-clock adjustment procedure described in the fourth embodiment, except that instead of determining how an entire histogram distribution varies as the dot-clock phase varies, the controller 6 only has to determine how the ratio supplied by the histogram ratio detector 18 varies. The current dot-clock frequency is recognized as correct if the variation in this ratio exceeds a predetermined level, and as incorrect of the variation does not exceed the predetermined level.

Figure 22:
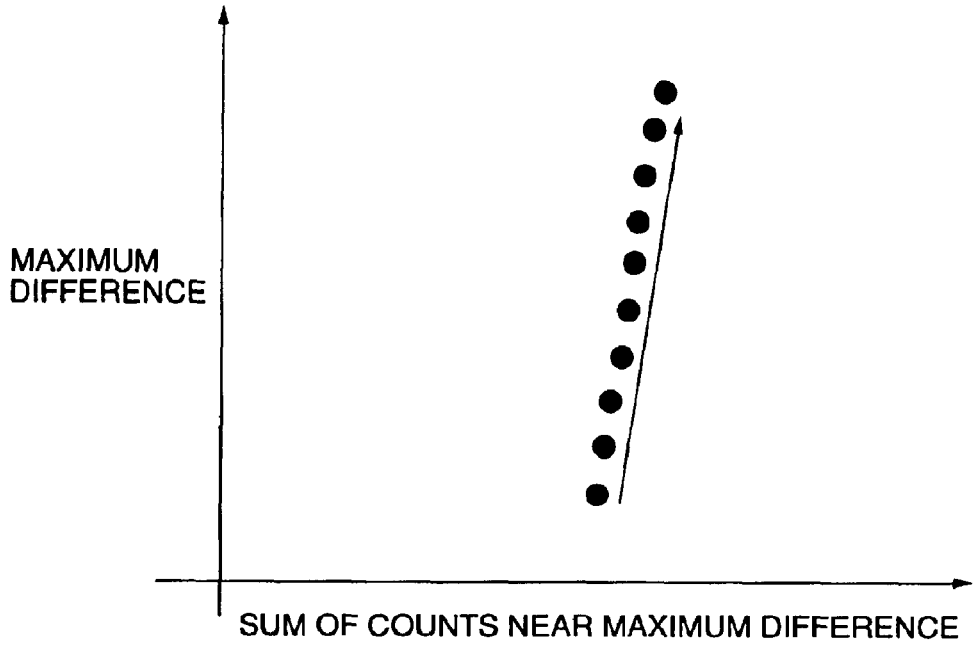
FIGS. 22 and 23 illustrate examples of histogram ratio characteristics.

FIG. 22 shows an example of the variation in this ratio for a vertical-stripe image, when the dot-clock frequency is correct. The maximum absolute difference value is shown on the vertical axis. The sum of the histogram counts in the predetermined neighborhood of the maximum value is shown on the horizontal axis. As the phase changes, as indicated by the arrow, the maximum absolute difference value changes greatly, while the sum of counts near that value remains relatively unchanged. The ratio between these two quantities thus varies by a large amount.

Figure 23:
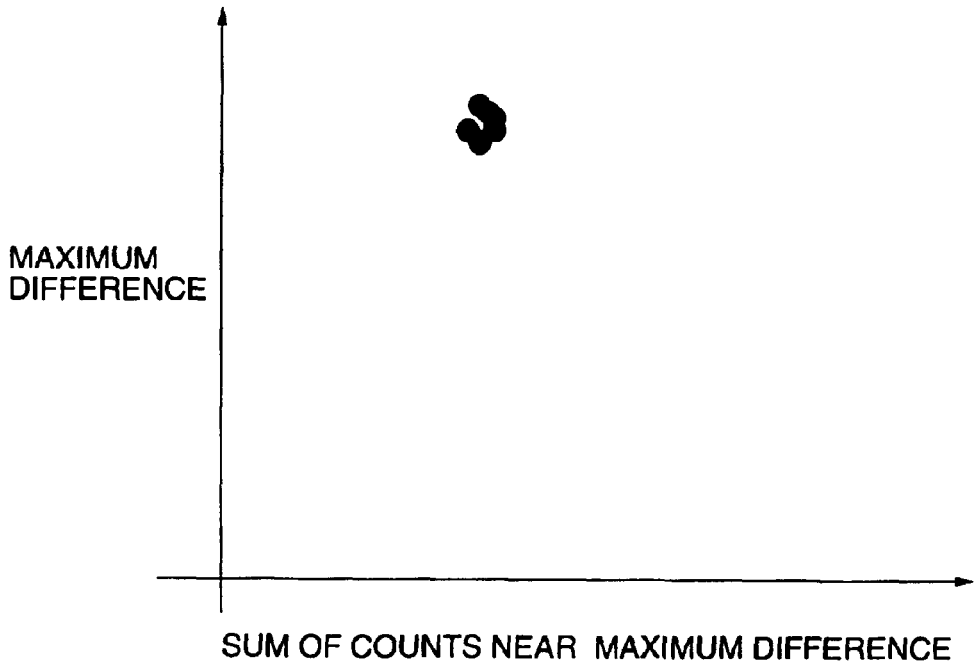

FIG. 23 shows an example of the variation in the same ratio for the same vertical-stripe image, when the dot-clock frequency is incorrect. Neither the maximum absolute difference value nor the sum of counts near this difference value varies greatly, so the ratio between them varies by only a small amount.

Compared with the fourth embodiment, the fifth embodiment reduces the amount of computation needed to compare different histogram distributions.

Compared with the first embodiment, the fifth embodiment enables the correct dot-clock frequency to be recognized from large variations in either the maximum absolute difference or the sum of histogram counts near that difference. The correct dot-clock frequency can accordingly be detected from a wider variety of images than in the first embodiment.

The preceding embodiments have shown three different image characteristics that can be used to adjust the dot-clock frequency. One characteristic is the maximum absolute difference between adjacent pixel values in a predetermined interval, as in the first three embodiments. Another characteristic is the entire histogram distribution of these absolute difference values, as in the fourth embodiment. Yet another characteristic is a ratio derived from the histogram, as in the fifth embodiment.

These embodiments have also shown three different image characteristics that can be used to adjust the dot-clock phase. One characteristic is the maximum absolute difference between adjacent pixel values in a predetermined interval, as in the first embodiment. Another characteristic is the absolute difference between the values of a predetermined pair of adjacent pixels, as in the second embodiment. Yet another characteristic is the absolute difference between the values of a pair of pixels selected as having the maximum absolute difference at a certain dot-clock phase.

The above embodiments have illustrated five combinations of the frequency-adjustment characteristic and the phase-adjustment characteristic, but the invention is not limited to these particular combinations. Any combination can be used.

Figure 24:
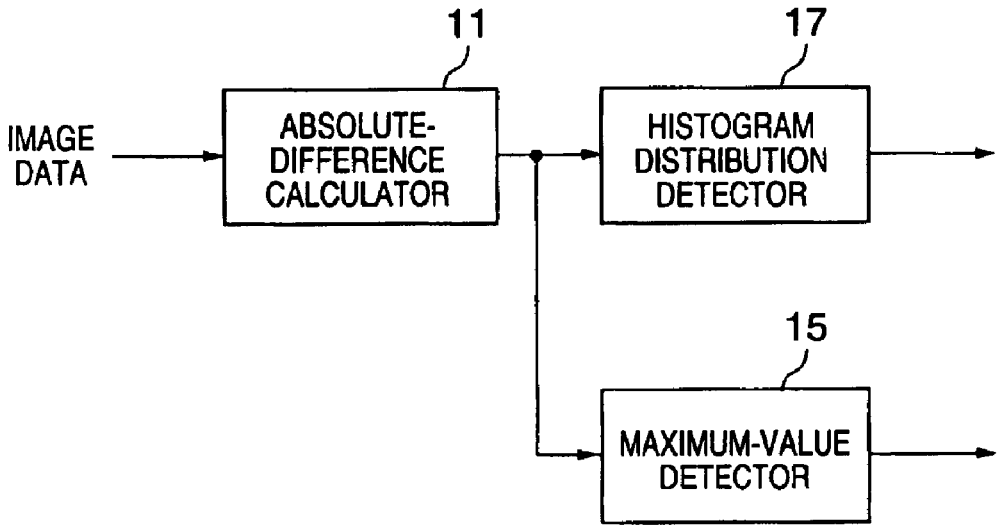
FIGS. 24, 25, 26, and 27 are block diagrams illustrating further variations of the image-characteristic detector in the apparatus shown in FIG. 6.

FIG. 24 shows the structure of an image-characteristic detector 5 suitable for combining the histogram distribution characteristic with the maximum absolute difference characteristic. The histogram distribution detector 17 supplies the controller 6 with histogram data for adjusting the dot-clock frequency. The maximum-value detector 15 supplies the controller 6 with maximum detected absolute difference values for adjusting the dot-clock phase.

Figure 25:
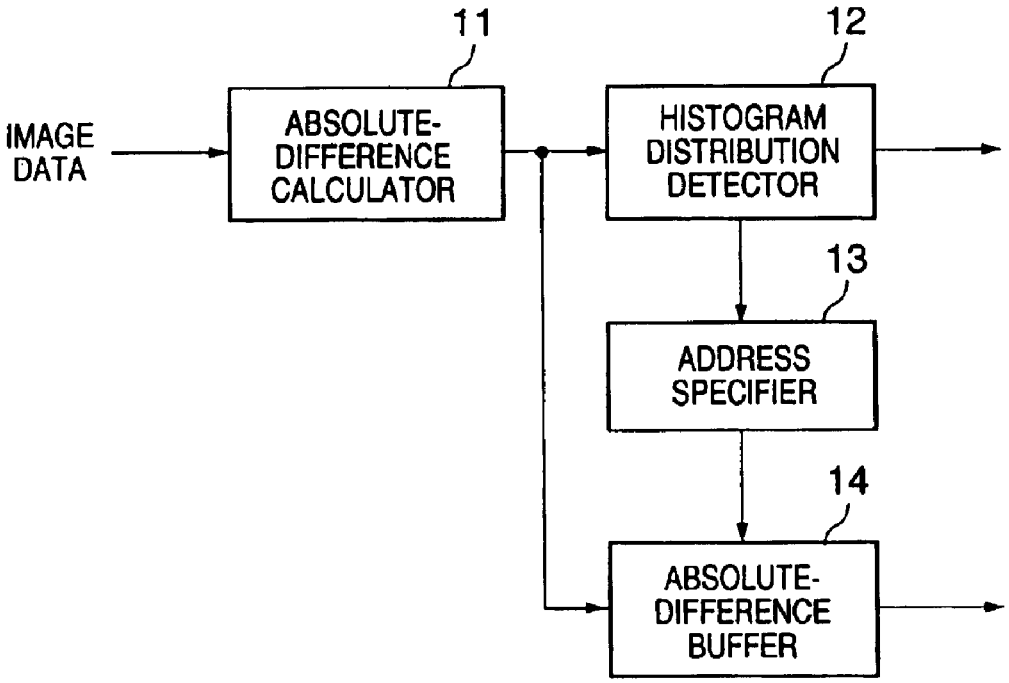

FIG. 25 shows the structure of an image-characteristic detector 5 suitable for combining the histogram distribution characteristic with the fixed-address difference characteristic. The histogram distribution detector 17 supplies the controller 6 with histogram data for adjusting the dot-clock frequency. The absolute-difference buffer 14 supplies the controller 6 with the absolute difference data for a predetermined pair of pixels, for adjusting the dot-clock phase.

Figure 26:
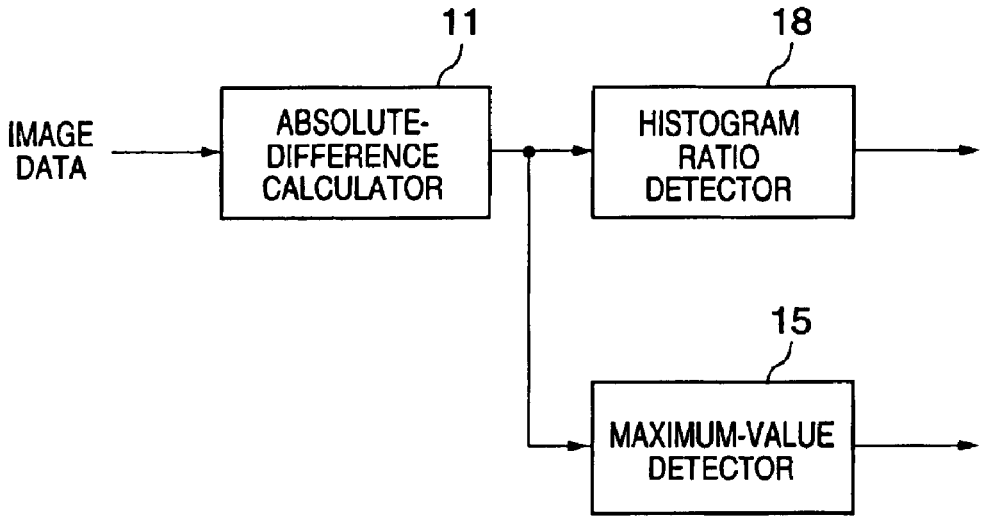

FIG. 26 shows the structure of an image-characteristic detector 5 suitable for combining the histogram ratio characteristic with the maximum absolute difference characteristic. The histogram ratio detector 18 supplies the controller 6 with ratio data, as described in the fifth embodiment, for adjusting the dot-clock frequency. The maximum-value detector 15 supplies the controller 6 with maximum detected absolute difference data for adjusting the dot-clock phase.

Figure 27:
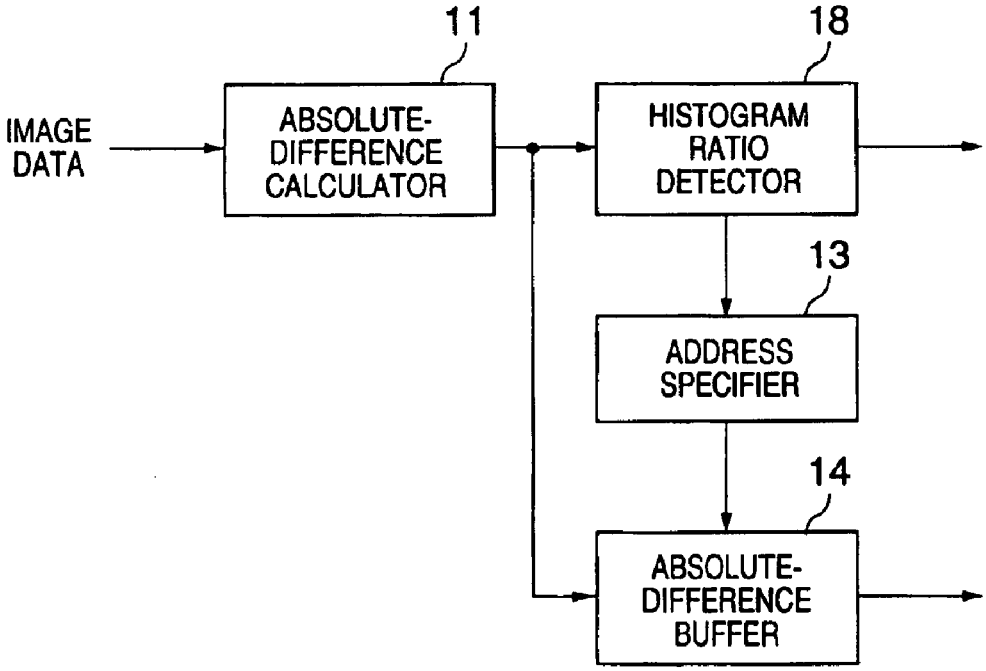

FIG. 27 shows the structure of an image-characteristic detector 5 suitable for combining the histogram ratio characteristic with the fixed-address difference characteristic. The histogram ratio detector 18 supplies the controller 6 with ratio data, as described in the fifth embodiment, for adjusting the dot-clock frequency. The absolute-difference buffer 14 supplies the controller 6 with the absolute difference data for a predetermined pair of pixels, for adjusting the dot-clock phase.

The invented method and apparatus enable the dot-clock frequency and phase to be adjusted accurately, regardless of whether or not the input image signal has a standard format, and regardless of whether or not the image fills the entire screen. In particular, if a histogram distribution or ratio characteristic is used for adjusting the dot-clock frequency, and the difference between a selected pair of pixels is used for adjusting the dot-clock phase, the dot-clock adjustments can be completed successfully with a wide variety of image signals and image content.

The embodime described above make no provision for halting the adjustment process if a correct dot-clock frequency cannot be found. To ensure that the adjustment ends within a reasonable time, it may be preferable to set an upper limit on the number of different dot-clock frequencies that are tried, and display an error message if no correct dot-clock frequency is found within the limit number of trials. An appropriate error message is, for example, a message advising the user to select a different image signal, by selecting a different signal source or channel, after which the automatic adjustment process can be repeated. Alternatively, the message may advise the user to adjust the dot-clock frequency manually, if the apparatus is equipped for manual adjustment.

The preceding embodiments can also be modified by measuring the algebraic difference between adjacent pixel values, instead of the absolute difference. Substantially the same results are obtained, without the need for absolute-value calculations, but when the dot-clock phase is adjusted, the controller 6 may have to select the phase that minimizes the detected difference characteristic, instead of the phase that maximizes the difference. The controller 6 is preferably equipped to decide from the shape of the characteristic curve whether to select the phase that gives the minimum or maximum characteristic value.

Similarly, the maximum value detector 12 in the image-characteristic detector 5 may have to select a maximally negative value; that is, a minimum value. In other words, the maximum value detector 12 selects an extremum value, which may be either positive or negative.

When a characteristic curve such as the one in FIG. 8 is obtained, showing a broad maximum between two sharply defined minima, the optimum phase can be identified as the phase located midway between the two minima. Similarly, if an algebraic difference characteristic is used and the characteristic curve has a broad minimum disposed between two sharp maxima, the phase midway between the two maxima can be selected as the optimum phase. The controller 6 is preferably equipped to recognize these types of characteristic curves and make these selections.

In determining the difference between two histogram distributions in the fourth embodiment, the controller 6 can consider the difference between the maximum absolute difference values detected by the absolute-difference calculator 11 in each histogram. In this case, the histogram distribution characteristic includes the maximum absolute difference characteristic used in the first three embodiments. This modification of the fourth embodiment enhances the ability of the controller 6 to recognize the correct dot-clock frequency.

The invention is not limited to the characteristics described above. Various other characteristics, such as the mean absolute difference between adjacent pixels, can be used to adjust the dot-clock frequency or phase.

Those skilled in the art will recognize that further variations are possible within the scope claimed below.

What is claimed is:

1. A method of adjusting a dot clock in an image display apparatus, comprising the steps of:

(a) sampling an image signal in synchronization with the dot clock, the dot clock having a certain frequency and phase;

(b) calculating a first image characteristic by calculating differences between consecutively sampled values over a certain interval in the image signal and obtaining an extremum value from the calculated differences over the certain interval, the extremum value being specified as the first image characteristic;

(c) repeating said steps (a) and (b) while varying the phase of the dot clock, thereby measuring the first image characteristic over a range of phase values;

(d) deciding, from results obtained in step (c), whether the frequency of the dot clock is correct; and (e) changing the frequency of the dot clock and repeating said steps (a) to (d), if the frequency of the dot clock is incorrect.

2. The method of claim 1, wherein said step (d) comprises the further steps of:

determining an amount of variation in the first image characteristic with respect to the phase of the dot clock;

comparing said amount of variation with a predetermined level;

recognizing the frequency of the dot clock as correct if said amount of variation exceeds the predetermined level; and recognizing the frequency of the dot clock as incorrect if said amount of variation does not exceed the predetermined level.

3. The method of claim 1, further comprising the steps of:

(f) determining a second image characteristic from said differences between consecutively sampled values with the dot clock having the frequency recognized as correct in said step (d);

(g) repeating said step (f) while varying the phase of the dot clock, thereby measuring the second image characteristic over a range of phase values; and (h) adjusting the phase of the dot clock according to results obtained in step (g).

4. The method of claim 3, wherein said step (g) adjusts the phase of the dot clock according to extrema of the second image characteristic.

5. The method of claim 3, wherein the second image characteristic is an extremum value of said differences between consecutively sampled values over said certain interval.

6. The method of claim 3, wherein the second image characteristic is a difference between the sampled values of a particular pair of samples.

7. The method of claim 6, wherein said pair of samples is selected as yielding a maximum difference in sampled values when the dot clock is set to a certain phase.

8. The method of claim 1, wherein the first image characteristic is a maximum absolute difference value between said consecutively sampled values.

9. A method of adjusting a dot clock in an image display apparatus, comprising the steps of:

(a) sampling an image signal in synchronization with the dot clock, the dot clock having a certain frequency and phase;

(b) calculating a first image characteristic by calculating differences between consecutively sampled values over a certain interval in the image signal and obtaining a histogram distribution from the number of times each difference value is detected over the certain interval, the histogram distribution being specified as the first image characteristic;

(c) repeating said steps (a) and (b) while varying the phase of the dot clock, thereby measuring the first image characteristic over a range of phase values;

(d) deciding, from results obtained in step (c), whether the frequency of the dot clock is correct; and (e) changing the frequency of the dot clock and repeating said steps (a) to (d), if the frequency of the dot clock is incorrect.

10. The method of claim 9, wherein said step (d) comprises the further steps of:

determining an amount of variation in the first image characteristic with respect to the phase of the dot clock;

comparing said amount of variation with a predetermined level;

recognizing the frequency of the dot clock as correct if said amount of variation exceeds the predetermined level; and recognizing the frequency of the dot clock as incorrect if said amount of variation does not exceed the predetermined level.

11. The method of claim 9, further comprising the steps of:

(f) determining a second image characteristic from said differences between consecutively sampled values with the dot clock having the frequency recognized as correct in said step (d);

(g) repeating said step (f) while varying the phase of the dot clock, thereby measuring the second image characteristic over a range of phase values; and (h) adjusting the phase of the dot clock according to results obtained in step (g).

12. The method of claim 11, wherein said step (g) adjusts the phase of the dot clock according to extrema of the second image characteristic.

13. The method of claim 11, wherein the second image characteristic is an extremum value of said differences between consecutively sampled values over said certain interval.

14. The method of claim 11, wherein the second image characteristic is a difference between the sampled values of a particular pair of samples.

15. The method of claim 14, wherein said pair of samples is selected as yielding a maximum difference in sampled values when the dot clock is set to a certain phase.

16. A method of adjusting a dot clock in an image display apparatus, comprising the steps of:

(a) sampling an image signal in synchronization with the dot clock, the dot clock having a certain frequency and phase;

(b) calculating a first image characteristic by calculating differences between consecutively sampled values over a certain interval in the image signal and obtaining an extremum value from the calculated differences over the certain interval and obtaining a total count of the differences that differ from the extremum value by less than a predetermined amount and using the extremum value and the total count to obtain a ratio value, the ratio value being specified as the first image characteristic;

(c) repeating said steps (a) and (b) while varying the phase of the dot clock, thereby measuring the first image characteristic over a range of phase values;

(d) deciding, from results obtained in step (c), whether the frequency of the dot clock is correct; and (e) changing the frequency of the dot clock and repeating said steps (a) to (d), if the frequency of the dot clock is incorrect.

17. The method of claim 16, wherein said step (d) comprises the further steps of:

determining an amount of variation in the first image characteristic with respect to the phase of the dot clock;

comparing said amount of variation with a predetermined level;

recognizing the frequency of the dot clock as correct if said amount of variation exceeds the predetermined level; and recognizing the frequency of the dot clock as incorrect if said amount of variation does not exceed the predetermined level.

18. The method of claim 16, further comprising the steps of:

(f) determining a second image characteristic from said differences between consecutively sampled values with the dot clock having the frequency recognized as correct in said step (d);

(g) repeating said step (f) while varying the phase of the dot clock, thereby measuring the second image characteristic over a range of phase values; and (h) adjusting the phase of the dot clock according to results obtained in step (g).

19. The method of claim 18, wherein said step (g) adjusts the phase of the dot clock according to extrema of the second image characteristic.

20. The method of claim 18, wherein the second image characteristic is an extremum value of said differences between consecutively sampled values over said certain interval.

21. The method of claim 18, wherein the second image characteristic is a difference between the sampled values of a particular pair of samples.

22. The method of claim 21, wherein said pair of samples is selected as yielding a maximum difference in sampled values when the dot clock is set to a certain phase.

23. An apparatus for adjusting a dot clock in an image display apparatus, the dot clock having a frequency and a phase, the apparatus comprising:

an analog-to-digital converter sampling an image signal in synchronization with the dot clock;

an image-characteristic detector coupled to the analog-to-digital converter, calculating a first image characteristic by calculating differences between consecutively sampled values over a certain interval in the image signal and obtaining an extremum value from the calculated differences over the certain interval, the extremum value being specified as the first image characteristic; and a controller coupled to the image-characteristic detector, varying the phase of the dot clock, thereby causing the image-characteristic detector to measure the first image characteristic over a range of phase values, and deciding, from the first image characteristic measured over said range of phase values, whether the frequency of the dot cock is correct.

24. The apparatus of claim 23, wherein the controller determines an amount of variation in the first image characteristic with respect to the phase of the dot clock, compares said amount of variation with a predetermined level, recognizes the frequency of the dot clock as correct if said amount of variation exceeds the predetermined level, and changes the frequency of the dot clock if said amount of variation does not exceed the predetermined level.

25. The apparatus of claim 23, wherein:

the image-characteristic detector also determines a second image characteristic from said differences between consecutively sampled values, when the dot clock is set to the correct frequency; and the controller varies the phase of the dot clock while the image-characteristic detector repeatedly determines the second image characteristic, and adjusts the phase of the dot clock according to the second image characteristic as determined over said range of phase values.

26. The apparatus of claim 25, wherein the controller adjusts the phase of the dot clock according to extrema of the second image characteristic.

27. The apparatus of claim 25, wherein the second image characteristic is an extremum value of said differences between consecutively sampled values over said certain interval.

28. The apparatus of claim 25, wherein the second image characteristic is a difference between the sampled values of a particular pair of samples.

29. The apparatus of claim 28, wherein the image-characteristic detector selects said pair of samples as yielding a maximum difference in sampled values when the dot clock is set to a certain phase.

30. The apparatus of claim 23, wherein the first image characteristic is a maximum absolute difference value between said consecutively sampled values.

31. An apparatus for adjusting a dot clock in an image display apparatus, the dot clock having a frequency and a phase, the apparatus comprising:

an analog-to-digital converter sampling an image signal in synchronization with the dot clock;

an image-characteristic detector coupled to the analog-to-digital converter, calculating a first image characteristic by calculating differences between consecutively sampled values over a certain interval in the image signal and obtaining a histogram distribution from the number of times each difference value is detected over the certain interval, the histogram distribution being specified as the first image characteristic; and a controller coupled to the image-characteristic detector, varying the phase of the dot clock, thereby causing the image-characteristic detector to measure the first image characteristic over a range of phase values, and deciding, from the first image characteristic measured over said range of phase values, whether the frequency of the dot cock is correct wherein the first image characteristic is an extremum value of said differences between consecutively sampled values over said certain interval.

32. An apparatus for adjusting a dot clock in an image display apparatus, the dot clock having a frequency and a phase, the apparatus comprising:

an analog-to-digital converter sampling an image signal in synchronization with the dot clock;

an image-characteristic detector coupled to the analog-to-digital converter, calculating a first image characteristic by calculating differences between consecutively sampled values over a certain interval in the image signal and obtaining an extremum value from the calculated difference over the certain interval and obtaining a total count of the differences that differ from the extremum value by less than a predetermined amount and using the extremum value and the total count to obtain a ratio value, the ratio value being specified as the first image characteristic; and a controller coupled to the image-characteristic detector, varying the phase the dot clock, thereby causing the image-characteristic detector to measure the first image characteristic over a range of phase values, and deciding, from the first image characteristic measured over said range of phase values, whether the frequency of the dot cock is correct.

* * * * *